US011798465B2

(12) United States Patent
Kim et al.

(10) Patent No.: US 11,798,465 B2
(45) Date of Patent: Oct. 24, 2023

(54) DISPLAY DEVICE AND METHOD OF DRIVING THE SAME

(71) Applicant: SAMSUNG DISPLAY CO., LTD., Yongin-si (KR)

(72) Inventors: Dong Hwi Kim, Yongin-si (KR); Jin Jeon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/936,916

(22) Filed: Sep. 30, 2022

(65) Prior Publication Data

US 2023/0162664 A1 May 25, 2023

(30) Foreign Application Priority Data

Nov. 22, 2021 (KR) ..... 10-2021-0161692

(51) Int. Cl.
*G09G 3/32* (2016.01)

(52) U.S. Cl.
CPC ..... *G09G 3/32* (2013.01); *G09G 2310/0278* (2013.01); *G09G 2320/0247* (2013.01); *G09G 2330/021* (2013.01)

(58) Field of Classification Search
CPC ..... G09G 3/32; G09G 2310/0278; G09G 2320/0247; G09G 2330/021
See application file for complete search history.

(56) References Cited

U.S. PATENT DOCUMENTS

| | | | | |
|---|---|---|---|---|
| 7,414,599 | B2 | 8/2008 | Chung et al. | |
| 11,056,049 | B2 | 7/2021 | Kim et al. | |
| 2017/0061875 | A1* | 3/2017 | Cho | G09G 3/3233 |
| 2019/0164491 | A1* | 5/2019 | Kim | H10K 59/131 |
| 2019/0164494 | A1* | 5/2019 | Bae | G09G 3/3258 |
| 2020/0111420 | A1* | 4/2020 | Yang | G09G 3/3258 |
| 2021/0375193 | A1 | 12/2021 | Son et al. | |

FOREIGN PATENT DOCUMENTS

| | | |
|---|---|---|
| KR | 10-0560780 | 3/2006 |
| KR | 10-2021-0148475 | 12/2021 |

* cited by examiner

*Primary Examiner* — Matthew A Eason
*Assistant Examiner* — Sujit Shah
(74) *Attorney, Agent, or Firm* — F. Chau & Associates, LLC

(57) ABSTRACT

A display device includes a pixel including a first transistor connected between a first node and a second node, an emission driver supplying an emission control signal to an emission control line, a scan driver supplying first to fourth scan signals respectively to first to fourth scan lines, and a data driver supplying a data signal to a data line. The first scan signal controls a timing at which a voltage of a first power source is supplied to the first node, the second scan signal controls a timing at which the second node and a gate electrode of the first transistor are connected to each other, and the third scan signal controls a timing at which a voltage of a second power source is supplied to the gate electrode of the first transistor. The second scan signal overlaps the first scan signal and the third scan signal.

23 Claims, 22 Drawing Sheets

DISPLAY DEVICE AND METHOD OF DRIVING THE SAME

CROSS-REFERENCE TO RELATED APPLICATION

This application claims priority under 35 U.S.C. § 119 to Korean Patent Application No. 10-2021-0161692, filed on Nov. 22, 2021 in the Korean Intellectual Property Office, the disclosure of which is incorporated by reference herein in its entirety.

TECHNICAL FIELD

Embodiments of the present disclosure relate generally to a display device, and more particularly, to a display device capable of operating at various frame frequencies, and a method of driving the display device.

DISCUSSION OF RELATED ART

A display device having low power consumption improves the driving efficiency of the display device. For example, a driving frequency (or data write frequency) may become low when a still image is displayed, thereby reducing the power consumption of the display device. In addition, the display device may display an image at various frame frequencies (or driving frequencies) for the purpose of image display in various conditions.

However, leakage of a driving current in a pixel may occur due to a low driving frequency, and a flicker of an image, or other image phenomenon, may occur. In addition, image distortion may be viewed due to a change in frame frequency, a change in frame response speed, etc.

SUMMARY

Embodiments of the present disclosure provide a display device capable of increasing image quality with respect to various frame frequencies by controlling a bias state of a driving transistor of a pixel.

Embodiments of the present disclosure also provide a method of driving the display device.

In accordance with an aspect of the present disclosure, there is provided a display device including: a pixel including a first transistor connected between a first node and a second node that generates a driving current, the pixel being connected to a first scan line, a second scan line, a third scan line, a fourth scan line, an emission control line, and a data line; an emission driver configured to supply an emission control signal to the emission control line at a first frequency; a scan driver configured to supply first to fourth scan signals respectively to the first to fourth scan lines within a period in which the emission control signal is supplied; and a data driver configured to supply a data signal to the data line, wherein the first scan signal controls a timing at which a voltage of a first power source is supplied to the first node, the second scan signal controls a timing at which the second node and a gate electrode of the first transistor are connected to each other, and the third scan signal controls a timing at which a voltage of a second power source is supplied to the gate electrode of the first transistor, and wherein the second scan signal overlaps at least a portion of the first scan signal and at least a portion of the third scan signal.

The pixel may further include: a light emitting element; a second transistor connected between the data line and the first node, the second transistor being turned on in response to the fourth scan signal; a third transistor connected between the second node and a third node connected to the gate electrode of the first transistor, the third transistor being turned on in response to the second scan signal; a fourth transistor connected between the first node and a second power line through which the voltage of the first power source is provided, the fourth transistor being turned on in response to the first scan signal; a fifth transistor connected between a first power line through which a voltage of a driving power source is provided and the first node, the fifth transistor being turned off in response to the emission control signal supplied to the emission control line; and a sixth transistor connected between the second node and a first electrode of the light emitting element, the sixth transistor being turned off in response to the emission control signal supplied to the emission control line.

The scan driver may supply the first scan signal to the first scan line in a first period and a second period, which are consecutive, and supply the second scan signal to the second scan line in the second period.

The fourth transistor may be turned on in the first period and the second period. The third transistor may be turned on in the second period.

In a third period, the scan driver may supply the third scan signal to the third scan line, and supply the second scan signal to the second scan line.

The pixel may further include a seventh transistor connected between the third node and a third power line through which a voltage of a second power source is provided, the seventh transistor being turned on in response to the third scan signal.

In the third period, the seventh transistor may be turned on, and the third transistor may be turned on in a state in which the seventh transistor is turned on.

In a fourth period, the scan driver may supply the second scan signal and the fourth scan signal respectively to the second scan line and the fourth scan line. The second transistor and the third transistor may be turned on in the fourth period.

The scan driver may supply the first scan signal to the first scan line in a fifth period. The emission driver may allow the fifth and sixth transistors to be turned off by supplying the emission control signal during the first to fifth periods.

The first, second, fourth, fifth, and sixth transistors may include active regions formed in a poly-silicon semiconductor layer. The poly-silicon semiconductor layer may include: a first semiconductor pattern including the active regions of the first, second, fifth, and sixth transistors; and a second semiconductor pattern including the active region of the fourth transistor, the second semiconductor pattern being separated from the first semiconductor pattern.

The third and seventh transistors may include active regions formed in an oxide semiconductor layer different from the poly-silicon semiconductor layer.

The pixel may further include an eighth transistor connected between the first electrode of the light emitting element and a fourth power line through which a voltage of a third power source is provided, the eighth transistor being turned on in response to the first scan signal.

The pixel may further include an eighth transistor connected between the first electrode of the light emitting element and a fourth power line through which a voltage of a third power source is provided, the eighth transistor being turned on in response to the emission control signal. Types of the eighth transistor and the fifth transistor may be different from each other.

The scan driver may further supply a fifth scan signal to a fifth scan line connected to the pixel. The pixel may further include an eighth transistor connected between the first electrode of the light emitting element and a fourth power line through which a voltage of a third power source is provided, the eighth transistor being turned on in response to the fifth scan signal. The fifth scan signal may have a reversed waveform of the first scan signal.

The scan driver may supply each of the first scan signal and the second scan signal a plurality of times in a non-emission period.

Pulse widths of the first to third scan signals may be greater than a pulse width of the fourth scan signal.

The scan driver may supply the third scan signal and the fourth scan signal at a second frequency corresponding to a frame frequency. The second frequency may be equal to or lower than the first frequency.

One frame period may include a plurality of non-emission periods divided by the emission control signal. The scan driver may supply the first scan signal in the non-emission periods. The scan driver may supply the second scan signal, the third scan signal, and the fourth scan signal in only a first non-emission period among the non-emission periods.

The scan driver may maintain the supply of the second scan signal to overlap each of the first scan signal, the third scan signal, and the fourth scan signal. The scan driver may supply the first scan signal, the third scan signal, and the fourth scan signal at different times not to overlap each other.

In accordance with an aspect of the present disclosure, there is provided a method of driving a display device for driving a pixel which is connected to a first scan line, a second scan line, a third scan line, a fourth scan line, an emission control line, and a data line and includes a first transistor connected between a first node and a second node to generate a driving current, the method including: applying a voltage of a first power source to a first electrode of the first transistor by supplying a first scan signal to the first scan line in a first period; allowing the first transistor to be diode-connected by supplying the first scan signal and a second scan signal respectively to the first scan line and the second scan line in a second period; applying a voltage of a second power source to a gate electrode and a second electrode of the first transistor by supplying the second scan signal and a third scan signal respectively to the second scan line and the third scan line in a third period; writing a data signal to the first transistor by supplying the second scan signal and a fourth scan signal respectively to the second scan line and the fourth scan line in a fourth period; and again applying the voltage of the first power source to the first electrode of the first transistor by supplying the first scan signal to the first scan line in a fifth period.

The pixel may further include: a light emitting element; a second transistor connected between the data line and the first node, the second transistor being turned on in response to the fourth scan signal; a third transistor connected between the second node and a third node connected to the gate electrode of the first transistor, the third transistor being turned on in response to the second scan signal; a fourth transistor connected between the first node and a second power line through which the voltage of the first power source is provided, the fourth transistor being turned on in response to the first scan signal; a fifth transistor connected between a first power line through which a voltage of a driving power source is provided and the first node, the fifth transistor being turned off in response to the emission control signal supplied to the emission control line; a sixth transistor connected between the second node and a first electrode of the light emitting element, the sixth transistor being turned off in response to the emission control signal supplied to the emission control line; and a seventh transistor connected between the third node and a third power line through which a voltage of the second power source is provided, the seventh transistor being turned on in response to the third scan signal.

The pixel may further include an eighth transistor connected between the first electrode of the light emitting element and a fourth power line through which a voltage of a third power source is supplied, the eighth transistor being turned on in response to the first scan signal. The voltage of the third power source may be supplied to the first electrode of the light emitting element through the eighth transistor in the first period and the fifth period.

The emission control signal may be supplied at a first frequency, and the third scan signal and the fourth scan signal may be supplied at a second frequency corresponding to a frame frequency. The second frequency may be equal to or lower than the first frequency.

One frame period may include a plurality of non-emission periods divided by the emission control signal. The first scan signal may be supplied in the non-emission periods. The second scan signal, the third scan signal, and the fourth scan signal may be supplied in only a first non-emission period among the non-emission periods.

BRIEF DESCRIPTION OF THE DRAWINGS

The above and other features of the present disclosure will become more apparent by describing in detail embodiments thereof with reference to the accompanying drawings, in which.

DETAILED DESCRIPTION

Figure 1:
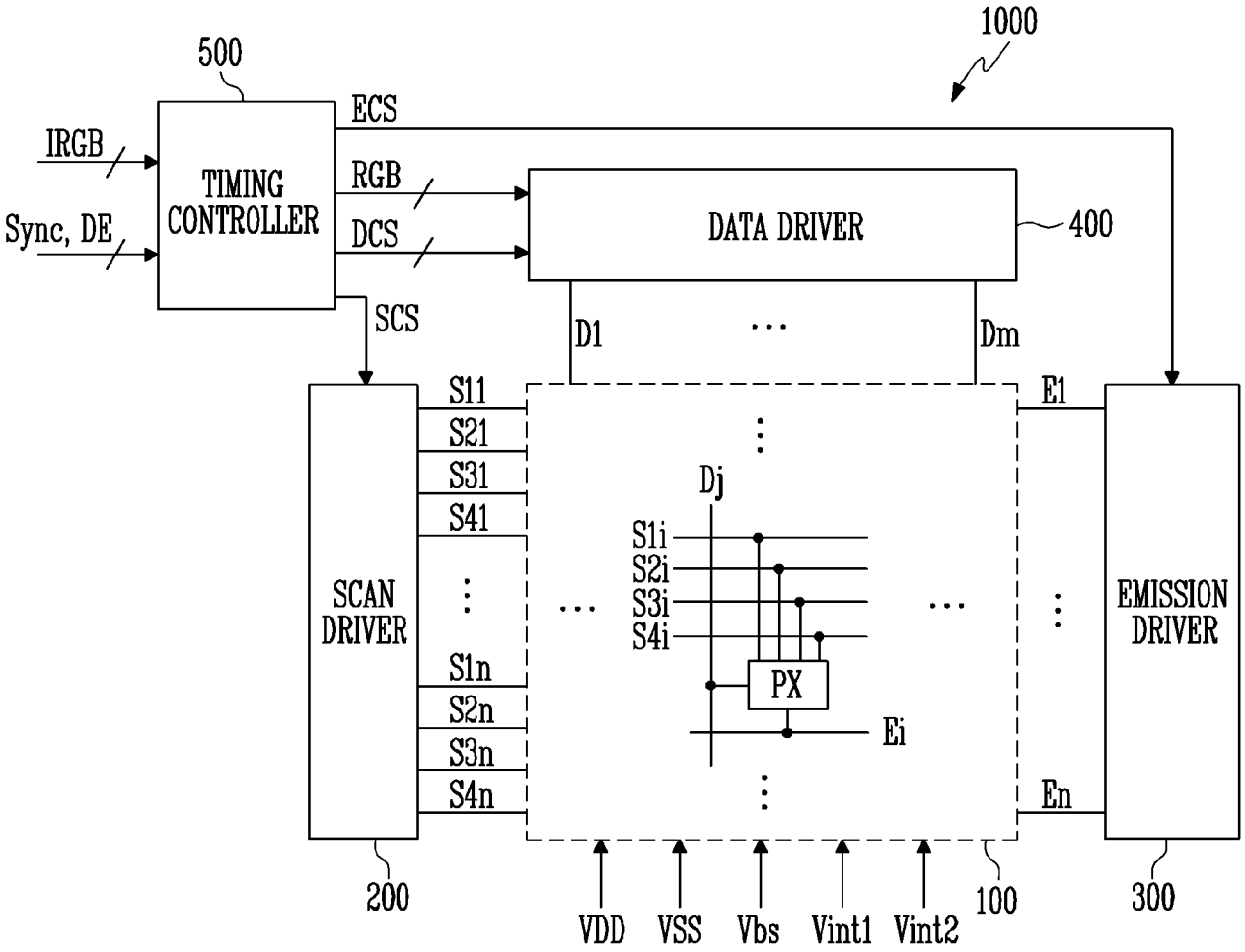
FIG. 1 is a diagram illustrating a display device in accordance with embodiments of the present disclosure.

Embodiments of the present disclosure will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms. Thus, a "first" element in an embodiment may be described as a "second" element in another embodiment.

It should be understood that descriptions of features or aspects within each embodiment should typically be considered as available for other similar features or aspects in other embodiments, unless the context clearly indicates otherwise.

As used herein, the singular forms "a", "an" and "the" are intended to include the plural forms as well, unless the context clearly indicates otherwise.

As used herein, the term "and/or" includes any and all combinations of one or more of the associated listed items.

Spatially relative terms, such as "beneath", "below", "lower", "under", "above", "upper", etc., may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below.

It will be understood that when a component such as a film, a region, a layer, or an element, is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present. It will also be understood that when a component is referred to as "covering" another component, it can be the only component covering the other component, or one or more intervening components may also be covering the other component. Other words used to describe the relationships between components should be interpreted in a like fashion.

Herein, when two or more elements or values are described as being substantially the same as or about equal to each other, it is to be understood that the elements or values are identical to each other, the elements or values are equal to each other within a measurement error, or if measurably unequal, are close enough in value to be functionally equal to each other as would be understood by a person having ordinary skill in the art. For example, the term "about" as used herein is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations as understood by one of the ordinary skill in the art. Further, it is to be understood that while parameters may be described herein as having "about" a certain value, according to exemplary embodiments, the parameter may be exactly the certain value or approximately the certain value within a measurement error as would be understood by a person having ordinary skill in the art. Other uses of these terms and similar terms to describe the relationships between components should be interpreted in a like fashion.

FIG. 1 is a diagram illustrating a display device in accordance with embodiments of the present disclosure.

Referring to FIG. 1, the display device 1000 may include a pixel portion 100, a scan driver 200, an emission driver 300, a data driver 400, and a timing controller 500.

The display device 1000 may display an image at various frame frequencies (e.g., refresh rates, driving frequencies, or screen refresh rates) according to driving conditions. The frame frequency is a frequency at which a data voltage is substantially written to a driving transistor of a pixel PX for one second. For example, the frame frequency is also referred to as a screen scan rate or a screen refresh frequency, and represents a frequency at which a display screen is refreshed for one second.

In an embodiment, an output frequency of the data driver 400 and/or a fourth scan signal supplied to a fourth scan line S4*i* to supply a data signal may be changed corresponding to a frame frequency. For example, a frame frequency for moving image driving may be a frequency of about 60 Hz or higher (e.g., about 120 Hz). When the frame frequency is 60 Hz, the fourth scan signal may be supplied 60 times per one second to each horizontal line (pixel row).

In an embodiment, the display device 1000 may adjust an output frequency of the scan driver 200 and the emission driver 300 and an output frequency of the data driver 400, which corresponds thereto, according to driving conditions. For example, the display device 1000 may display an image, corresponding to various frame frequencies of about 1 Hz to about 120 Hz. However, this is merely illustrative, and the display device 1000 may also display an image at a frame frequency of about 120 Hz or higher (e.g., about 240 Hz or about 480 Hz).

The pixel portion 100 may include scan lines S11 to S1*n*, S21 to S2*n*, S31 to S3*n*, and S41 to S4*n*, emission control lines E1 to En, and data lines D1 to Dm, and include pixels PX connected to the scan lines S11 to S1*n*, S21 to S2*n*, S31 to S3*n*, and S41 to S4*n*, the emission control lines E1 to En, and the data lines D1 to Dm (m and n are integers greater than 1). Each of the pixels PX may include a driving transistor and a plurality of switching transistors.

The timing controller 500 may be supplied with input image data IRGB and control signals Sync and DE from a host system such as an Application Processor (AP) through a predetermined interface.

The timing controller 500 may generate a first control signal SCS, a second control signal ECS, and a third control signal DCS, based on the input image data IRGB, a synchronization signal Sync (e.g., a vertical synchronization signal, a horizontal synchronization signal, etc.), a data enable signal DE, a clock signal, etc. The first control signal SCS may be supplied to the scan driver 200, the second control signal ECS may be supplied to the emission driver 300, and the third control signal DCS may be supplied to the data driver 400. The timing controller 500 may supply image data RGB to the data driver 400 by rearranging the input image data IRGB.

The scan driver 200 may receive the first control signal SCS from the timing controller 500, and supply a first scan signal, a second scan signal, a third scan signal, and a fourth scan signal respectively to first scan lines S11 to S1*n*, second scan lines S21 to S2*n*, third scan lines S31 to S3*n*, and fourth scan lines S41 to S4*n*, based on the first control signal SCS.

The first to fourth scan signals may be set to a gate-on voltage (e.g., a low voltage) corresponding to the type of transistors to which the corresponding scan signals are supplied. A transistor receiving a scan signal may be set to a turn-on state when the scan signal is supplied.

For example, the gate-on voltage of a scan signal supplied to a P-channel metal oxide semiconductor (PMOS) transistor may have a logic low level, and the gate-on voltage of a scan signal supplied to an N-channel metal oxide semiconductor (NMOS) transistor may have a logic high level. Hereinafter, it will be understood that the term "that a scan signal is supplied" means that the scan signal is supplied with a logic level at which a transistor controlled by the scan signal is turned on.

In an embodiment, the scan driver 200 may supply some of the first to fourth scan signals a plurality of times in a non-emission period. Accordingly, a bias state of the driving transistor included in the pixel PX can be controlled.

The emission driver 300 may supply an emission control signal to the emission control lines E1 to En, based on the second control signal ECS. For example, the emission control signal may be sequentially supplied to the emission control lines E1 to En.

The emission control signal may be set to a gate-off voltage (e.g., a high voltage). A transistor receiving the emission control signal may be turned off when the emission control signal is supplied, and be set to the turn-on state in other cases. Hereinafter, it will be understood that the term "that the emission control signal is supplied" means that the emission control signal is supplied with a logic level at which a transistor controlled by the emission control signal is turned off.

For convenience of description, a case where each of the scan driver 200 and the emission driver 300 is a single component has been illustrated in FIG. 1, but embodiments of the present disclosure are not limited thereto. The scan driver 200 may include a plurality of scan drivers each of which supplies at least one of the first to fourth signals according to a design. In addition, at least a portion of the scan driver 200 and the emission driver 300 may be integrated as one driving circuit, one module, etc.

The data driver 400 may receive the third control signal DCS and the image data RGB from the timing controller 500. The data driver 400 may convert the image data RGB in a digital form into an analog data signal (e.g., a data voltage). The data driver 400 may supply a data signal to the data lines D1 to Dm, corresponding to the third control signal DCS. The data signal supplied to the data lines D1 to Dm may be supplied to be synchronized with the fourth scan signal supplied to the fourth scan lines S41 to S4*n*.

In an embodiment, the display device 1000 may further include a power supply. The power supply may supply, to the pixel portion 100, a voltage of a first driving power source VDD, a voltage of a second driving power source VSS, a voltage of a first power source Vbs (or bias power source), a voltage of a second power source Vint1 (or first initialization power source), and a voltage of a third power source Vint2 (or second initialization power source), which are used to drive the pixel PX.

The display device 1000 may operate at various frame frequencies. In the case of low frequency driving, an image defect such as, for example, a flicker may be viewed due to current leakage inside the pixel. In addition, an afterimage such as screen attraction may be viewed according to a change in bias state of the driving transistor due to, for example, driving at various frame frequencies, a change in response speed due to a threshold voltage shift caused by a hysteresis characteristic, etc.

To increase image quality, one frame period of the pixel PX may include one display scan period and at least one bias scan period according to a frame frequency. Operations of the display scan period and the bias scan period will be described in detail with reference to FIGS. 4 and 5.

Figure 2:
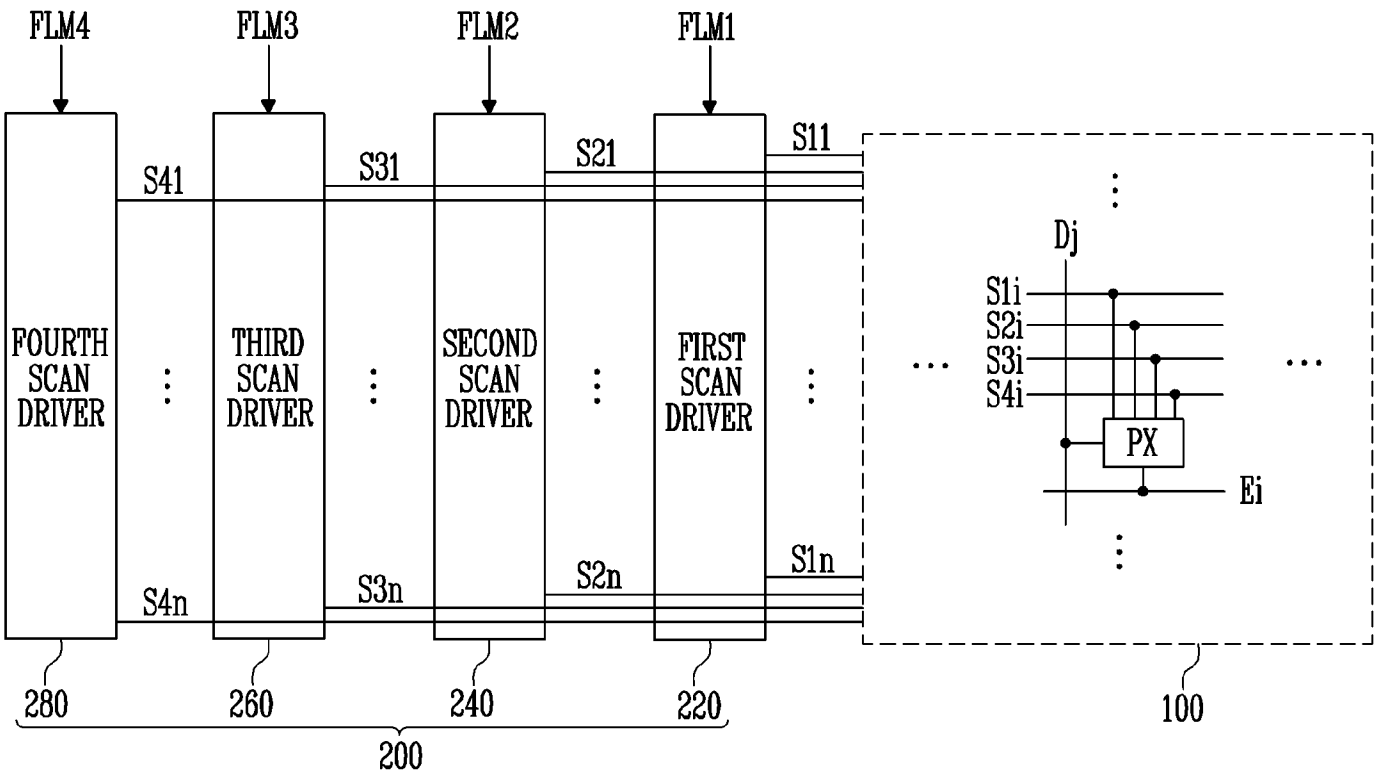
FIG. 2 is a diagram illustrating an example of a scan driver included in the display device shown in FIG. 1.

FIG. 2 is a diagram illustrating an example of the scan driver included in the display device shown in FIG. 1 in accordance with embodiments of the present disclosure.

Referring to FIGS. 1 and 2, the scan driver 200 may include a first scan driver 220, a second scan driver 240, a third scan driver 260, and a fourth scan driver 280.

The first control signal SCS may include first to fourth scan start signals FLM1 to FLM4. The first to fourth scan start signals FLM1 to FLM4 may be respectively supplied to the first to fourth scan drivers 220, 240, 260, and 280.

A pulse width, a supply timing, etc. of each of the first to fourth scan start signals FLM1 to FLM4 may be determined according to a driving condition of the pixel PX and a frame frequency. The first to fourth scan signals may be output based on the first to fourth scan start signals FLM1 to FLM4, respectively. For example, a signal width of at least one of the first to fourth scan signals may be different from a signal width of the other of the first to fourth scan signals.

The first scan driver 220 may sequentially supply the first scan signal to the first scan lines S11 to S1*n* in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3. The fourth scan driver 280 may sequentially supply the fourth scan signal to the fourth scan lines S41 to S4*n* in response to the fourth scan start signal FLM4.

Figure 3:
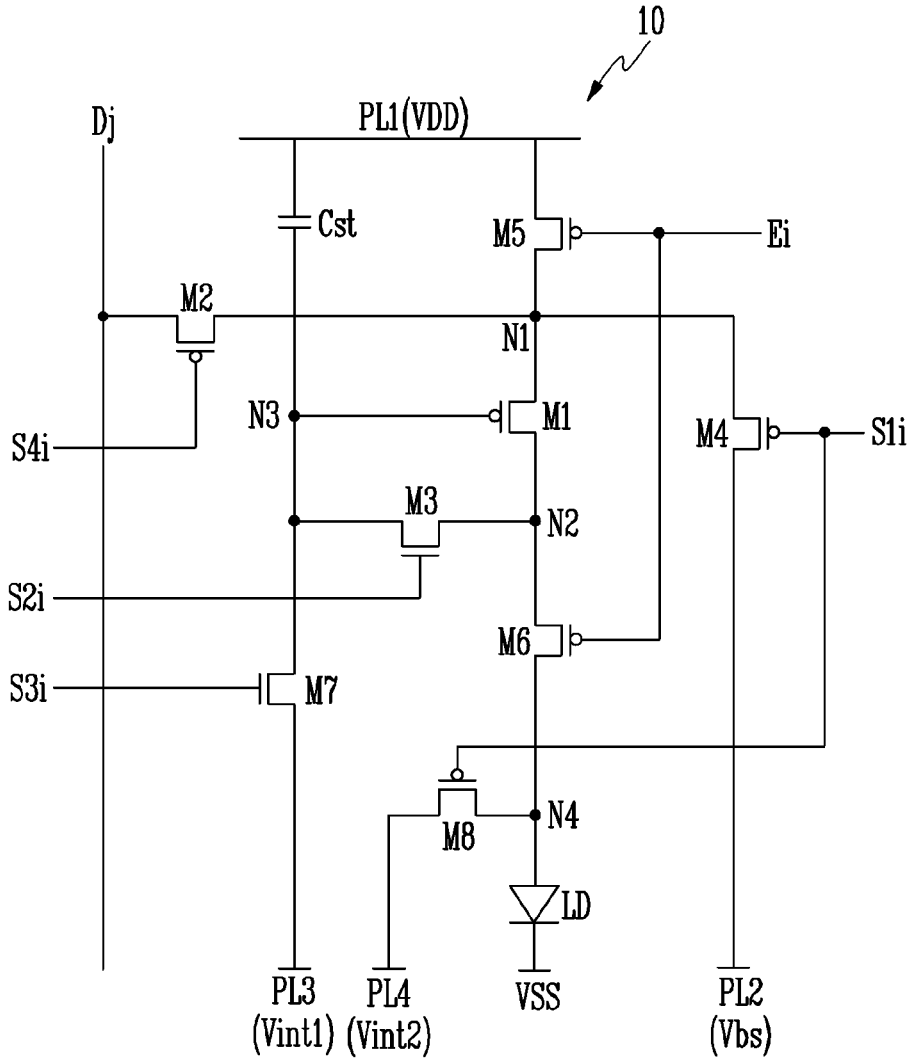
FIG. 3 is a circuit diagram illustrating an example of a pixel included in the display device shown in FIG. 1.

FIG. 3 is a circuit diagram illustrating an example of the pixel included in the display device shown in FIG. 1.

For convenience of description, a pixel 10 which is located on an ith horizontal line (or ith pixel row) and is connected to a jth data line Dj will be described with reference to FIG. 3 (i and j are positive integers).

Referring to FIGS. 1 and 3, the pixel 10 may include a light emitting element LD, first to eighth transistors M1 to M8, and a storage capacitor Cst.

A first electrode (anode electrode or cathode electrode) of the light emitting element LD may be connected to the sixth transistor M6, and a second electrode (cathode electrode or anode electrode) of the light emitting element LD may be connected to an electrode through which the second driving power source VSS is provided. The light emitting element LD may generate light with a predetermined luminance corresponding to an amount of current supplied from the first transistor M1.

In an embodiment, the light emitting element LD may be an organic light emitting diode including an organic emitting layer. In an embodiment, the light emitting element LD may be an inorganic light emitting element formed of an inorganic material. In an embodiment, the light emitting element LD may be a light emitting element configured with a combination of an organic material and an inorganic material. Alternatively, the light emitting element LD may have a form in which a plurality of inorganic light emitting elements are connected in parallel and/or series between the second driving power source VSS and the sixth transistor M6.

A first electrode of the first transistor M1 (or driving transistor) may be connected to a first node N1, and a second electrode of the first transistor M1 may be connected to a second node N2. A gate electrode of the first transistor M1 may be connected to a third node N3. The first transistor M1 may control an amount of current flowing from the first driving power source VDD to the second driving power source VSS via the light emitting element LD, corresponding to a voltage of the third node N3. To this end, the first driving power source VDD may be set to a voltage higher than that of the second driving power source VSS.

The second transistor M2 may be connected between the jth data line Dj (hereinafter, referred to as a data line) and the first node N1. A gate electrode of the second transistor M2 may be connected to an ith fourth scan line S4*i* (hereinafter, referred to as a fourth scan line). The second transistor M2 may be turned on when the fourth scan signal is supplied to the fourth scan line S4*i*, to electrically connect the data line Dj and the first node N1 to each other.

The third transistor M3 may be connected between the second electrode of the first transistor M1 (e.g., the second node N2) and the third node N3. A gate electrode of the third transistor M3 may be connected to an ith second scan line S2*i* (hereinafter, referred to as a second scan line). The third transistor M3 may be turned on when the second scan signal is supplied to the second scan line S2*i*, to electrically connect the second electrode of the first transistor M1 and the third node N3 to each other. That is, a timing at which the second electrode (e.g., a drain electrode) of the first transistor M1 and the gate electrode of the first transistor M1 are connected to each other may be controlled by the second scan signal. When the third transistor M3 is turned on, the first transistor M1 may be connected in a diode form.

The fourth transistor M4 may be connected between the first node N1 and a second power line PL2 through which the voltage of the first power source Vbs is provided. The fourth transistor M4 may be turned on in response to the first scan signal supplied to an ith first scan line S1*i* (hereinafter, referred to as a first scan line), and supply the voltage of the first power source Vbs to the first node N1. A timing at which the voltage of the first power source Vbs is supplied to the first node N1 may be controlled by the first scan signal.

In an embodiment, the voltage of the first power source Vbs may have a level similar to a level of a data signal of a black grayscale. For example, the voltage of the first power source Vbs may have a level of about 5V to about 7V. Alternately, the voltage of the first power source Vbs may be higher than the voltage of the first driving power source VDD, and be smaller than a voltage corresponding to the high level of scan signals.

Accordingly, a predetermined high voltage may be applied to the first electrode (e.g., a source electrode) of the first transistor M1 when the fourth transistor M4 is turned on. When the third transistor M3 is in a turn-off state, the first transistor M1 may have an on-bias state (e.g., a state in which the first transistor M1 can be turned on) (e.g., may be on-biased).

The fifth transistor M5 may be connected between a first power line PL1 through which the first driving power source VDD is provided and the first node N1. A gate electrode of the fifth transistor M5 may be connected to an ith emission control line Ei (hereinafter, referred to as an emission control line). The fifth transistor M5 may be turned off when the emission control signal is supplied to the emission control line Ei, and be turned on in other cases.

The sixth transistor M6 may be connected between the second electrode of the first transistor M1 (e.g., the second node N2) and the first electrode of the light emitting element LD (e.g., a fourth node N4). A gate electrode of the sixth transistor M6 may be connected to the emission control line Ei. The sixth transistor M6 may be controlled substantially identically to the fifth transistor M5.

The seventh transistor M7 may be connected between the third node N3 and a third power line PL3 through which the second power source Vint1 (hereinafter, referred to as a first initialization power source) is provided. A gate electrode of the seventh transistor M7 may be connected to an ith third scan line S3*i* (hereinafter, referred to as a third scan line).

The seventh transistor M7 may be turned on when the third scan signal is supplied to the third scan line S3*i*, to supply the voltage of the first initialization voltage Vint1 to the third node N3. The voltage of the first initialization power source Vint1 may be set as a voltage lower than the lowest level of the data signal supplied to the data line Dj.

Accordingly, a gate voltage of the first transistor M1 may be initialized to the voltage of the first initialization power source Vinit1 when the seventh transistor M7 is turned on.

The eighth transistor M8 may be connected between the first electrode of the light emitting element LD (e.g., the fourth node N4) and a fourth power line PL4 through which the third power source Vint2 (hereinafter, referred to as a second initialization power source) is provided. In an embodiment, a gate electrode of the eighth transistor M8 may be connected to the first scan line S1*i*.

The eighth transistor M8 may be turned on when the first scan signal is supplied to the first scan line S1*i*, to supply the voltage of the second initialization power source Vint2 to the first electrode of the light emitting element LD.

When the voltage of the second initialization power source Vint2 is supplied to the first electrode of the light emitting element LD, a parasitic capacitor of the light emitting element LD may be discharged. Since a residual voltage charged in the parasitic capacitor is discharged (eliminated), unintended fine emission can be prevented or reduced. Thus, a black expression capability of the pixel 10 can be increased.

In an embodiment, the first initialization power source Vint1 and the second initialization power source Vint2 may generate different voltages. That is, a voltage at which the third node N3 is initialized and a voltage at which the fourth node N4 is initialized may be set different from each other.

In low frequency driving in which the length of one frame period becomes long, when the voltage of the first initialization power source Vint1, which is supplied to the third node N3, is excessively low, a strong on-bias is applied to the first transistor M1, and therefore, the threshold voltage of the first transistor M1 in a corresponding frame period is shifted by a hysteresis characteristic of the first transistor M1. This characteristic may cause a flicker phenomenon in the low frequency driving. Therefore, the voltage of the first initialization power source Vint1, which is higher than the voltage of the second driving power source VSS, may be required in the low frequency driving of the display device.

However, when the voltage of the second initialization power source Vint2, which is supplied to the fourth node N4, becomes higher than a predetermined reference, the voltage of the parasitic capacitor of the light emitting element LD is not discharged but may be charged. Therefore, the voltage of the second initialization power source Vint2 is to be lower than the voltage of the second driving power source VSS.

However, this is merely illustrative. For example, according to embodiments, the voltage of the first initialization power source Vint1 and the voltage of the second initialization power source Vint2 may be substantially the same.

The storage capacitor Cst may be connected between the first power line PL1 and the third node N3. The storage capacitor Cst may store a voltage applied to the third node N3.

In an embodiment, the first transistor M1, the second transistor M2, the fourth transistor M4, the fifth transistor M5, the sixth transistor M6, and the eighth transistor M8 may be implemented with a poly-silicon semiconductor transistor. For example, the first transistor M1, the second transistor M2, the fourth transistor M4, the fifth transistor M5, the sixth transistor M6, and the eighth transistor M8 may include, as an active layer (channel), a poly-silicon semiconductor layer formed through a low temperature poly-silicon (LTPS) process.

Also, the first transistor M1, the second transistor M2, the fourth transistor M4, the fifth transistor M5, the sixth transistor M6, and the eighth transistor M8 may be implemented with a P-type transistor (e.g., a PMOS transistor). Accordingly, a gate-on voltage at which the first transistor M1, the second transistor M2, the fourth transistor M4, the fifth transistor M5, the sixth transistor M6, and the eighth transistor M8 are turned on may have a logic low level.

Since the poly-silicon semiconductor transistor has a fast response speed, the poly-silicon semiconductor transistor may be applied to a switching element which requires fast switching.

The third transistor M3 and the seventh transistor M7 may be implemented with an oxide semiconductor transistor. For example, the third transistor M3 and the seventh transistor M7 may be implemented with an N-type oxide semiconductor transistor (e.g., an NMOS transistor), and include an oxide semiconductor layer as an active layer. Accordingly, a gate-on voltage at which the third transistor M3 and the seventh transistor M7 are turned on may have a logic high level.

The oxide semiconductor transistor can be formed through a low temperature process, and have a charge mobility lower than that of a poly-silicon semiconductor transistor. That is, the oxide semiconductor transistor has an excellent off-current characteristic. Thus, when the third transistor M3 and the seventh transistor M7 are implemented with the oxide semiconductor transistor, leakage current from the third node N3 according to the low frequency driving can be minimized or reduced, and accordingly, display quality can be increased.

Figure 4:
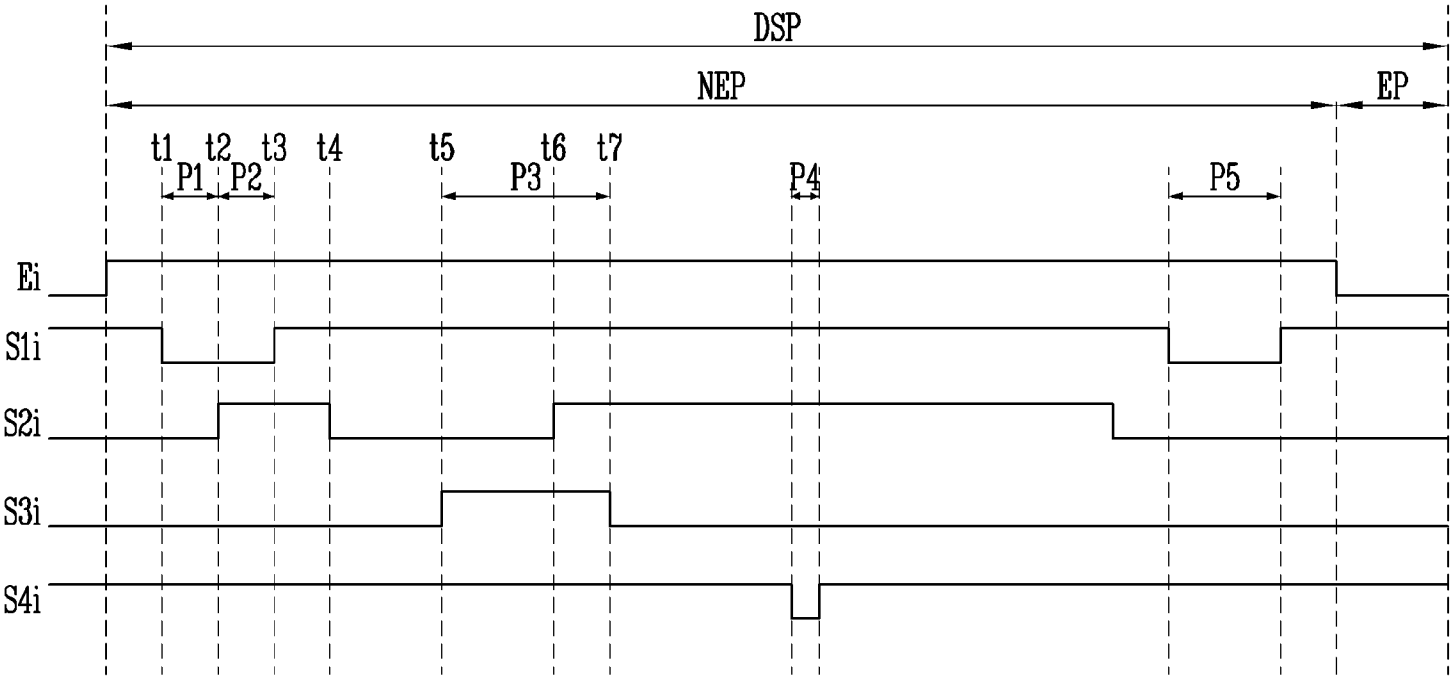
FIG. 4 is a timing diagram illustrating an example of signals supplied to the pixel shown in FIG. 3.
Figure 5:
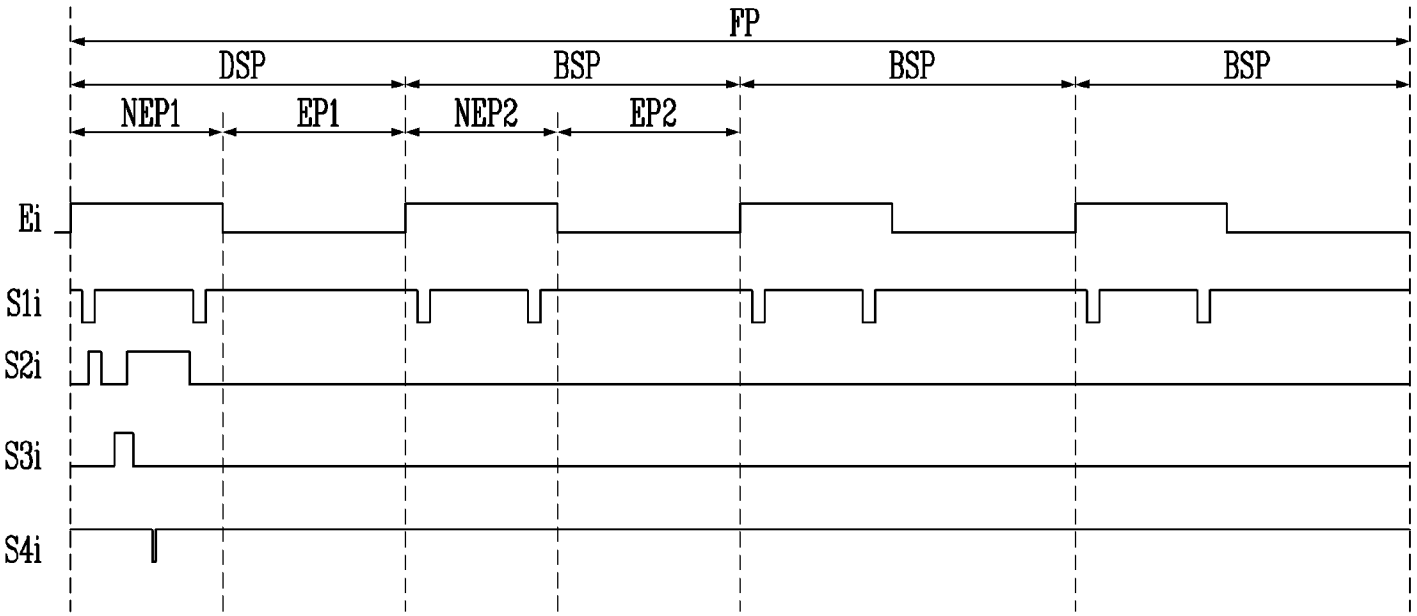
FIG. 5 is a timing diagram illustrating an example of the signals supplied to the pixel shown in FIG. 3 during one frame period.

FIG. 4 is a timing diagram illustrating an example of signals supplied to the pixel shown in FIG. 3. FIG. 5 is a timing diagram illustrating an example of the signals supplied to the pixel shown in FIG. 3 during one frame period.

Referring to FIGS. 3, 4, and 5, in variable frequency driving in which a frame frequency is controlled, one frame period FP may include a display scan period DSP and at least one bias scan period BSP.

The display scan period DSP may include a first non-emission period NEP1 and a first emission period EP1. The bias scan period BSP may include a second non-emission period NEP2 and a second emission period EP2. A non-emission period NEP and an emission period EP, which are shown in FIG. 4, may respectively correspond to the first non-emission period NEP1 and the first emission period EP1, which are shown in FIG. 5.

The display scan period DSP may include a period in which a data signal actually corresponding to an output image is written. For example, when a still image is displayed through low frequency driving, a data signal may be written for each display scan period DSP.

As shown in FIG. 5, the emission control signal may be supplied to the emission control line Ei at a first frequency equal to or higher than the frame frequency. The third scan signal and the fourth scan signal may be supplied at a second frequency lower than the first frequency. For example, the first frequency may be about 240 Hz, and the second frequency may be about 60 Hz. The frequency of the third scan signal and the fourth scan signal may be substantially equal to the frame frequency. The third scan signal may control a timing at which the voltage of the first initialization power source Vint1 is supplied to the gate electrode of the first transistor M1.

However, this is merely illustrative, and the second frequency may be less than about 60 Hz. A number of times the bias scan period BSP is repeated in the frame period FP (e.g., a number of bias scan periods BSP) as the second frequency becomes lower or as a difference between the first frequency and the second frequency becomes larger. For example, the frame period PF may include one display scan period DSP and a plurality of consecutive bias scan periods BSP according to the frame frequency.

In an embodiment, one frame period FP may include only a display scan period DSP. For example, the first frequency and the second frequency may correspond to the frame frequency, and the bias scan period may be omitted. For example, the emission control signal, the third scan signal, and the fourth scan signal may be supplied at about 240 Hz as the frame frequency.

In an embodiment, the second scan signal may be supplied in only the first non-emission period NEP1. The second scan signal may be supplied to the second scan line S2*i* a plurality of times in the first non-emission period NEP1. The second scan signal may control a timing at which the first electrode (source electrode) and the gate electrode of the first transistor M1 are connected (e.g., diode-connected) to each other.

In an embodiment, the first scan signal may be supplied in the first non-emission period NEP1 and the second non-emission period NEP2. The first scan signal may be supplied to the first scan line S1*i* a plurality of times in the first non-emission period NEP1.

Also, the first scan signal may be supplied to the first scan line S1*i* a plurality of times in the second non-emission period NEP2.

The first scan signal may control a timing at which the voltage of the first power source Vbs is supplied to the first node N1. The first scan signal may be a signal for controlling the first transistor M1 to be in the on-bias state. For example, when the fourth transistor M4 is turned on by the first scan signal, the voltage of the first power source Vbs may be supplied to the first node N1.

In the display device in accordance with embodiments of the present disclosure, the voltage of the first power source Vbs may be cyclically applied to the source electrode of the first transistor M1 by using the fourth transistor M4. When the voltage of the first power source Vbs is supplied to the source electrode of the first transistor M1, the first transistor M1 may be in the on-bias state, and a threshold voltage characteristic of the first transistor M1 may be changed. Thus, in the low frequency driving, a characteristic of the first transistor M1 is fixed to a specific state, so that degradation of the first transistor M1 can be prevented or reduced.

Although a case where the first scan signal is supplied in all the non-emission periods NEP1 and NEP2 is illustrated in FIG. 5, embodiments of the present disclosure are not limited thereto. For example, according to embodiments, the first scan signal may be supplied in only a portion of the second non-emission period NEP2. For example, the first scan signal may be supplied to the first scan line S1*i* in only the display scan period DSP and a second bias scan period BSP shown in FIG. 5.

A period in which the emission control signal has a logic low level may be an emission period EP, EP1 or EP2, and a period except the emission period EP, EP1 or EP2 may be a non-emission period NEP, NEP1 or NEP2.

A gate-on voltage of the second scan signal and the third scan signal, which are respectively supplied to the third transistor M3 and the seventh transistor M7 as N-type transistors, may be a logic high level. A gate-on voltage of the fourth scan signal and the first scan signal, which are supplied to the second transistor M2, the fourth transistor M4, and the eighth transistor M8 as P-type transistors, may have the logic low level.

As shown in FIG. 5, the first scan signal may be supplied to the first scan line S1*i* in the second non-emission period NEP2 as a non-emission period of the bias scan period BSP. Therefore, the voltage of the first power source Vbs may be supplied to the source electrode of the first transistor M1 in the second non-emission period NEP2. That is, on-bias stress may be cyclically applied to the first transistor M1, regardless of the frame frequency. For example, the first scan signal may be supplied to the first scan line S1*i* a plurality of times in the second non-emission period NEP2. Accordingly, in low frequency driving, a luminance change of the first transistor M1 in the frame period FP can be minimized or reduced. According to embodiments, the first scan signal may be supplied to the first scan line S1*i* a plurality of times even in the display scan period DSP so as to simplify driving of the scan driver 200 and the configuration of the display device 1000.

Hereinafter, scan signals supplied in the display scan period DSP and an operation of the pixel 10 will be described in detail with reference to FIG. 4.

In an embodiment, the second scan signal may overlap at least a portion of the first scan signal and at least a portion of the third scan signal. Therefore, a period in which the third transistor M3 and the fourth transistor M4 are simultaneously turned on and a period in which the third transistor M3 and the seventh transistor M7 are simultaneously turned on may exist.

During the non-emission period NEP, the emission control signal may be supplied to the emission control line Ei. Accordingly, during the non-emission period NEP, the fifth transistor M5 and the sixth transistor M6 may be turned off. The non-emission period NEP may include first to fifth periods P1 to P5.

In general, when a screen transition from a previous image to a current image occurs while having a sudden grayscale change, step efficiency is lowered, which is a ratio of a luminance just after the screen transition (e.g., a real luminance of a first frame after the screen transition) to a target luminance (e.g., an ideal luminance) of the current image.

In the first period P1, the scan driver 200 may supply the first scan signal to the first scan line S1*i*. The first scan signal may be changed to a low level at a first time t1. Accordingly, the fourth transistor M4 may be turned on, and the voltage of the first power source Vbs may be supplied to the first node N1 (e.g., the source electrode of the first transistor M1). The voltage of the first power source Vbs may have a level higher than a level of the voltage of the first driving power source VDD. In addition, the gate electrode of the first transistor M1 is in a floating state, and hence, the absolute value of a gate-source voltage of the first transistor M1 may be increased (e.g., on-biased) in the first period P1. Accordingly, the threshold voltage of the first transistor M1 is shifted in a direction in which the threshold voltage of the first transistor M1 is decreased, and the driving current is rapidly changed. Thus, the step efficiency may be increased.

In the second period P2, the scan driver 200 may supply the first scan signal to the first scan line S1*i*, and supply the second scan signal to the second scan line S2*i*. For example, the second scan signal may be changed to a high level at a second time t2. That is, in the second period P2, the first scan signal and the second scan signal overlap each other. In an embodiment, a time between the first time t1 and the second time t2 may correspond to one horizontal period. The one horizontal period may correspond to a time for which data is written to one pixel row.

In the second period P2, the third transistor M3 and the fourth transistor M4 may be turned on. The turn-on state of the fourth transistor M4 may be maintained from the first period P1 to the second period P2. When the third transistor M3 and the fourth transistor M4 are turned on, the first transistor M1 is diode-connected, and the magnitude of the gate-source voltage of the first transistor M1 may be decreased to a level corresponding to the absolute value of the threshold voltage of the first transistor M1.

In some embodiments, a hysteresis characteristic in which the threshold voltage and driving current generated by the first transistor M1 are changed according to a change in bias state of the first transistor M1 may have influence on step efficiency of an image. For example, fluctuation of the driving current and luminance according to the hysteresis characteristic may be decreased as a frequency at which the bias state of the first transistor M1 is changed during the same period becomes higher, and hence, the step efficiency of the image can be increased. Accordingly, in the second period, the first transistor M1 is turned off, and the bias state of the first transistor M1 is changed (e.g., is off-biased). Thus, the step efficiency may be further increased.

In an embodiment, during the first period P1 and the second period P2, the eighth transistor M8 may be turned on in response to the first scan signal, and the voltage of the second initialization power source Vint2 may be supplied to the first electrode of the light emitting element LD (e.g., the fourth node N4). Therefore, the voltage of the first electrode of the light emitting element LD may be initialized.

The first scan signal may be changed to the high level at a third time t3. Accordingly, the fourth transistor M4 and the eighth transistor M8 may be turned off at the third time t3.

In an embodiment, the supply of the second scan signal may be suspended at a fourth time t4. For example, the second scan signal may be changed to the low level at the fourth time t4. Accordingly, the third transistor M3 may be turned off at the fourth time t4.

Although a case where the fourth time t4 is posterior to the third time t3 is illustrated in FIG. 4, embodiments of the present disclosure are not limited thereto. For example, according to embodiments, the fourth time t4 and the third time t3 may be substantially the same.

In an embodiment, a pulse width of the first scan signal and the second scan signal may have two horizontal periods or more. Therefore, the first scan signal and the second scan signal may be commonly supplied to predetermined pixel rows adjacent to each other.

Subsequently, in the third period P3, the scan driver 200 may supply the third scan signal to the third scan line S3*i*. For example, the third scan signal may be changed to the high level at a fifth time, and be changed to the low level at a seventh time t7. In other words, a pulse width of the third scan signal may have two horizontal periods or more. Therefore, the third scan signal may be commonly supplied to predetermined pixel rows adjacent to each other.

During the third period P3, the seventh transistor M7 may be turned on in response to the third scan signal, and the voltage of the first initialization power source Vint1 may be supplied to the third node N3. Therefore, the gate voltage of the first transistor M1 may be initialized to the voltage of the first initialization power source Vint1. Thus, a strong on-bias is again applied to the first transistor M1 before data is written, and the threshold voltage of the first transistor M1 is shifted. Accordingly, a response speed can be increased. The third period P3 may correspond to the second horizontal periods or more.

The scan driver 200 may again supply the second signal to the second scan line S2*i* from a sixth time t6 in the third period P3. For example, the scan driver 200 may supply the second scan signal to the second scan line S2*i* twice during the non-emission period NEP.

The secondly supplied second scan signal may overlap the third scan signal and the fourth scan signal. For example, the supply of the second scan signal may be maintained until before the fifth period P5.

For example, from the sixth time t6 to the seventh time t7 of the third period P3, the third scan signal and the second scan signal may overlap each other, and the third transistor M3 and the seventh transistor M7 may simultaneously have the turn-on state. Therefore, the voltage of the first initialization power source Vint1 may be supplied to the second node N2, and a drain voltage of the first transistor M1 may be initialized to the voltage of the first initialization power source Vint1.

Also, in the fourth period P4, the scan driver 200 may further supply the fourth scan signal to the fourth scan line S4*i*. In an embodiment, a pulse width of the fourth scan signal may be equal to or smaller than one horizontal period. For example, pulse widths of the first to third scan signals may be greater than the pulse width of the fourth scan signal.

In the fourth period P4, the second transistor M2 and the third transistor M3 may be turned on respectively in response to the fourth scan signal and the second scan signal. Therefore, the data signal supplied to the data line Dj is supplied to the first node N1, and the first transistor M1 is diode-connected, so that data writing and compensation of the threshold voltage of the first transistor M1 can be performed. The supply of the second scan signal is maintained even after the supply of the fourth scan signal is suspended, and thus, the threshold voltage of the first transistor M1 can be compensated for a sufficient amount of time.

Unlike embodiments of the present disclosure, when the second scan signal is supplied after the supply of the third scan signal is suspended (e.g., when the third scan signal and the second scan signal do not overlap each other), a kickback phenomenon may occur in the voltage of the third node N3 (e.g., the gate voltage of the first transistor M1) due to coupling of a parasitic capacitance between the second scan line S2*i* and a conductive pattern corresponding to the third node N3. That is, the voltage of the third node N3 having the voltage of the first initialization power source Vint1 may be unintentionally increased due to an increase in the second scan signal.

Due to the increase in the voltage of the third node N3, loss may occur in the driving current, and light emission with a desired maximum luminance cannot be made. For example, a display device designed to have a light emission ability of 1200 nits may not be capable of emitting light with 1200 nits.

In order to eliminate, minimize or reduce the kickback phenomenon, the second scan signal may be supplied in a state in which the third scan signal is supplied in the third period P3. Thus, light emission with a high luminance of, for example, 1000 nits may be easily implemented.

Subsequently, in the fifth period P5, the scan driver 200 may again supply the first scan signal to the first scan line S1*i*. Therefore, the fourth transistor M4 and the eighth transistor M8 may be turned on. The voltage of the first power source Vbs may be supplied to the first node N1 when the fourth transistor M4 is turned on.

Influence of the strong on-bias applied in the second period P2 may be eliminated by writing of the data signal and threshold voltage compensation in the fourth period P4. For example, a voltage difference between the gate voltage and the source voltage of the first transistor M1 can be considerably decreased by the threshold voltage compensation in the fourth period P4. Then, the characteristic of the first transistor M1 may be again changed, and the driving current of the emission period EP may increase or excitation of the black grayscale may be viewed.

In order to prevent this characteristic change, the fourth transistor M4 may be turned on in the fifth period P5. Therefore, in the fifth period P5, the voltage of the first power source Vbs may be supplied to the source electrode of the first transistor M1, so that the first transistor M1 is set to the on-bias state.

Subsequently, the emission driver 300 may suspend the supply of the emission control signal to the emission control line Ei in the emission period EP. Accordingly, the fifth and sixth transistors M5 and M6 may be turned on, and a driving current based on the data signal may be supplied to the light emitting element LD through the first transistor M1. The light emitting element LD may emit light with a luminance corresponding to the driving current.

As described above, in the display device 1000 and the method of driving the same in accordance with embodiments of the present disclosure, the hysteresis characteristics of the first transistor M1 may be additionally improved by turning on the third transistor M3 in the second period P2 in a state in which the fourth transistor M4 is turned on to apply the on-bias to the first transistor M1 in the first period P1, so that the step efficiency may be increased.

Further, in the display device 1000 and the method of driving the same in accordance with embodiments of the present disclosure, the kickback phenomenon occurring in the gate voltage of the first transistor M1 may be eliminated, minimized or reduced by turning on the third transistor M3 in a state in which the seventh transistor M7 is turned on to initialize the gate voltage of the first transistor M1 in the third period P3, so that light emission with a high luminance of 1000 nits may be easily implemented.

Figure 6:
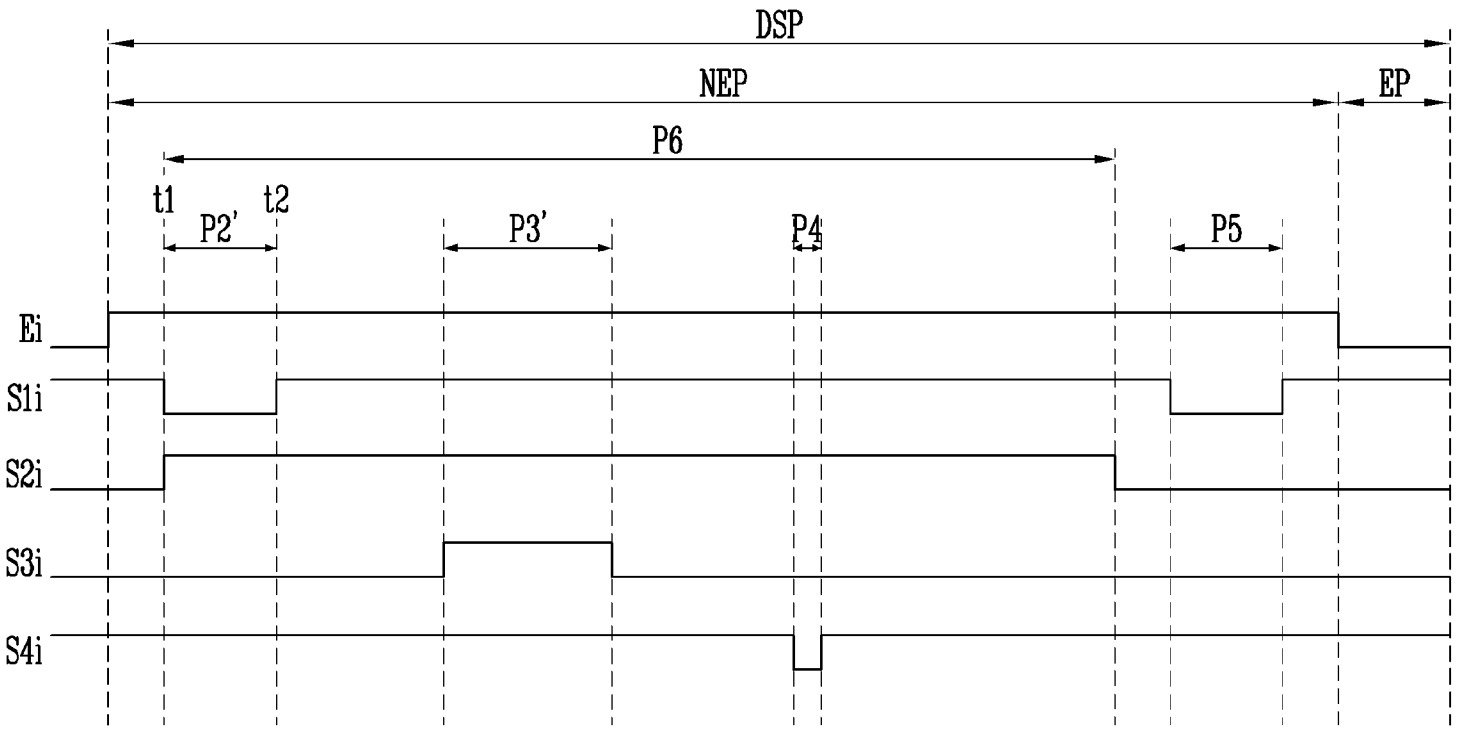
FIG. 6 is a timing diagram illustrating an example of the signals supplied to the pixel shown in FIG. 3.

FIG. 6 is a timing diagram illustrating an example of the signals supplied to the pixel shown in FIG. 3.

The timing diagram shown in FIG. 6 is identical or similar to the timing diagram shown in FIG. 4, except the second scan signal. Therefore, for convenience of explanation, components identical or corresponding to those shown in FIG. 4 are designated by like reference numerals, and overlapping descriptions will be omitted.

Referring to FIGS. 1, 3, and 6, the non-emission period NEP of the display scan period DSP may include a second period P2', a third period P3', a fourth period P4, and a fifth period P5.

An operation of the second period P2' shown in FIG. 6 may be substantially identical to the operation of the second period P2, which is described with reference to FIG. 4. In other words, the first scan signal and the second scan signal may be simultaneously supplied at a first time t1. The second period P2' may be a period from the first time t1 to a second time t2, in which the first scan signal has the low level.

In the second period P2', the third transistor M3, the fourth transistor M4, and the eighth transistor M8 are simultaneously turned on, and the step efficiency can be increased as the same effect as the operation in the second period P2 shown in FIG. 4.

In an embodiment, the scan driver 200 may maintain the supply of the second scan signal to overlap each of the first scan signal, the third scan signal, and the fourth scan signal. For example, the second scan signal may start being supplied at the first time t1 and then be maintained until before the fifth period P5 (e.g., during a sixth period P6).

In the third period P3', the third scan signal may be further supplied to the third scan line S3*i*. Therefore, during the third period P3', the third transistor M3 and the seventh transistor M7 may be turned on, and the voltage of the first initialization power source Vint1 may be supplied to the second node N2 and the third node N3. Since the second scan signal and the third scan signal overlap each other, the kickback phenomenon occurring in the gate voltage of the first transistor M1 according to transition of scan signals may be eliminated, minimized or reduced.

As described above, the second scan signal is supplied as one pulse for a relatively long time. Thus, in the display device and the method of driving the same in accordance with an embodiment as shown in FIG. 6, power consumption can be reduced as compared with an embodiment as shown in FIG. 4.

Figure 7:
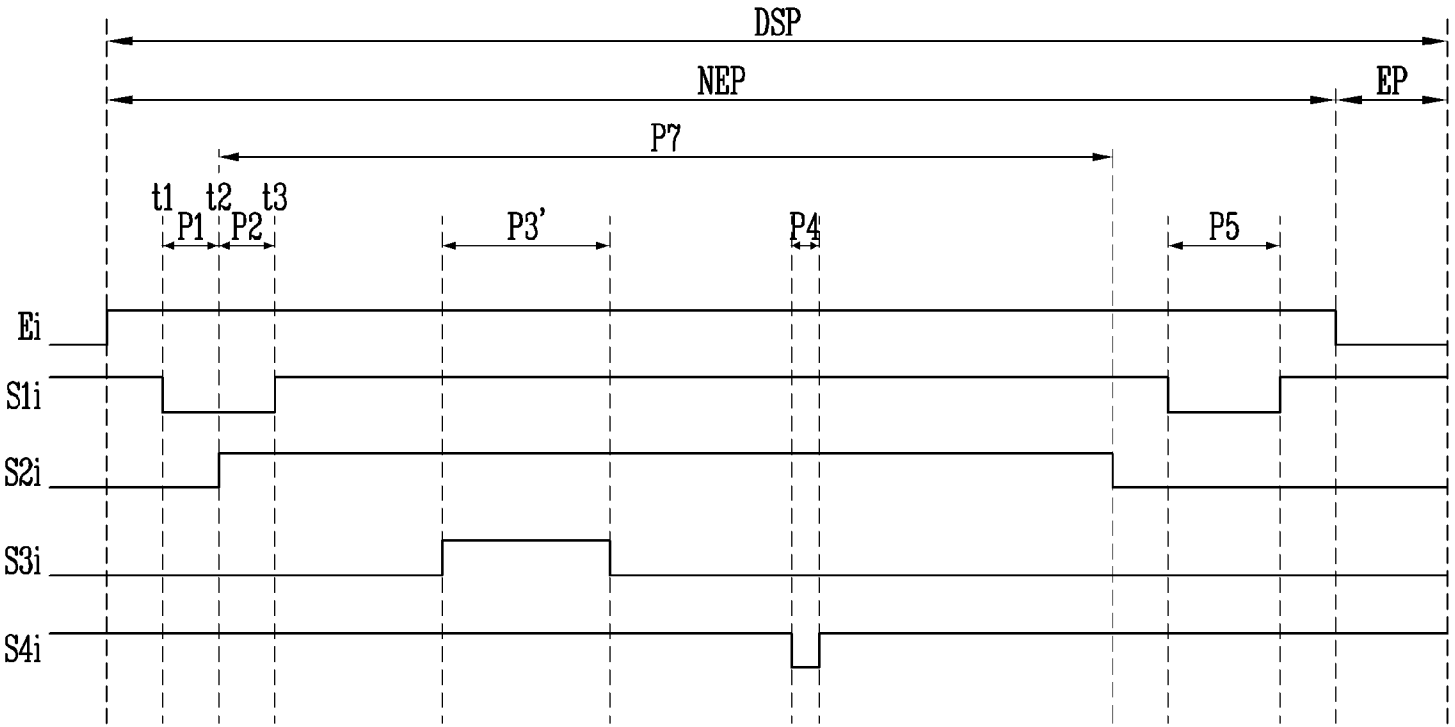
FIG. 7 is a timing diagram illustrating an example of the signals supplied to the pixel shown in FIG. 3.

FIG. 7 is a timing diagram illustrating an example of the signals supplied to the pixel shown in FIG. 3.

The timing diagram shown in FIG. 7 is identical or similar to the timing diagram shown in FIG. 4 or 6, except the second scan signal. Therefore, for convenience of explanation, components identical or corresponding to those shown in FIG. 4 or 6 are designated by like reference numerals, and overlapping descriptions will be omitted.

Referring to FIGS. 1, 3, and 7, the non-emission period NEP of the display scan period DSP may include a first period P1, a second period P2, a third period P3', a fourth period P4, and a fifth period P5.

An operation of the first period P1 and the second period P2, shown in FIG. 7, is substantially identical to the operation of the first period P1 and the second period P2, shown in FIG. 4. For example, the first scan signal may be supplied from a first time t1, and the second scan signal may be supplied from a second time t2. Thus, the step efficiency can be increased as the same effect as the operation in the first period P1 and the second period P2, shown in FIG. 4.

In an embodiment, the scan driver 200 may maintain the supply of the second scan signal to overlap each of the first scan signal, the third scan signal, and the fourth scan signal. For example, the second scan signal may start being supplied at the second time t2 and then be maintained until before the fifth period P5 (e.g., during a seventh period P7).

As described above, in the display device and the method of driving the same in accordance with an embodiment as shown in FIG. 7, power consumption can be reduced as compared with an embodiment as shown in FIG. 4, and the step efficiency can be further increased as compared with an embodiment as shown in FIG. 6.

Figure 8:
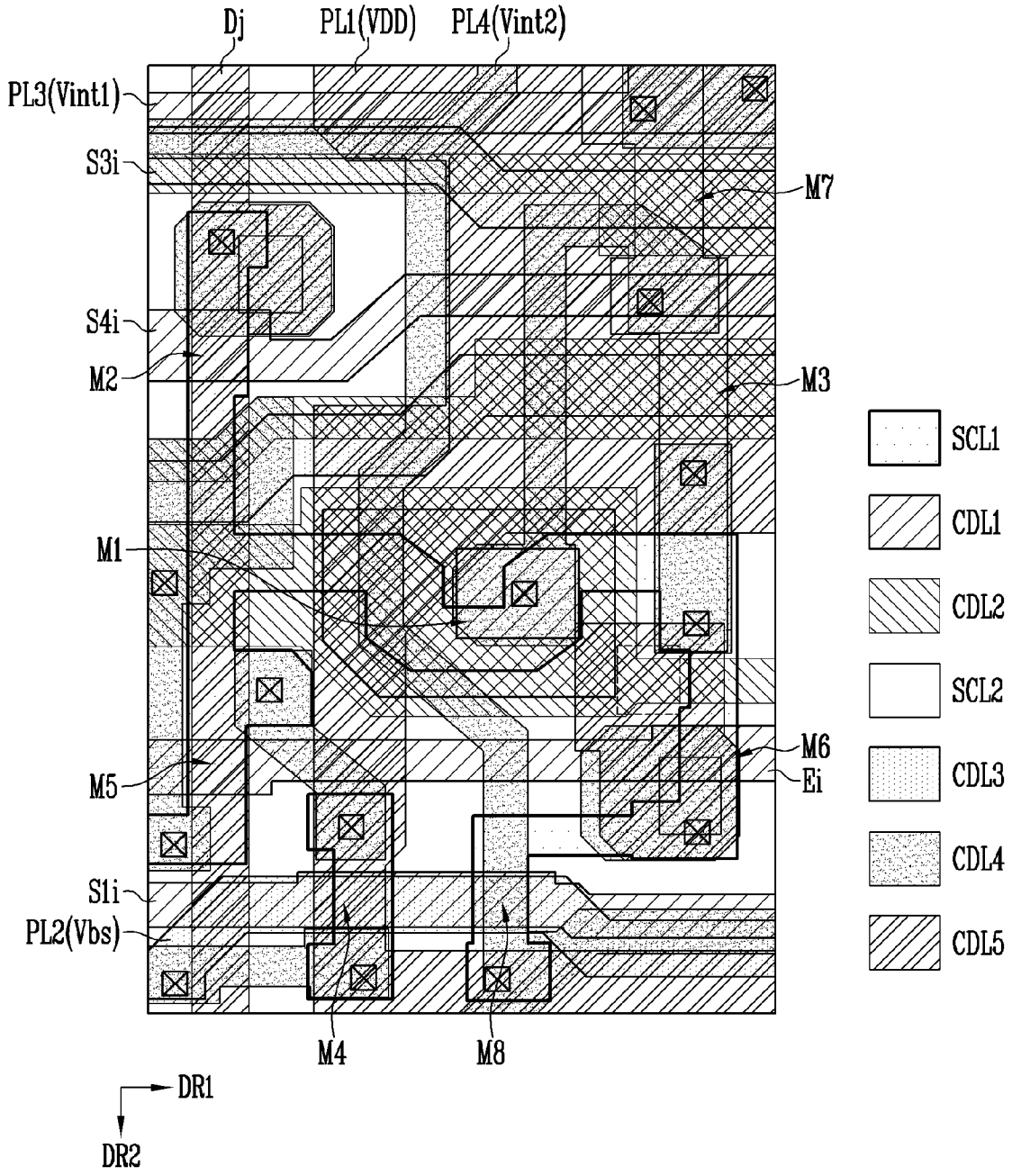
FIG. 8 is a layout view illustrating an example of a backplane structure including a pixel circuit included in the pixel shown in FIG. 3.
Figure 9:
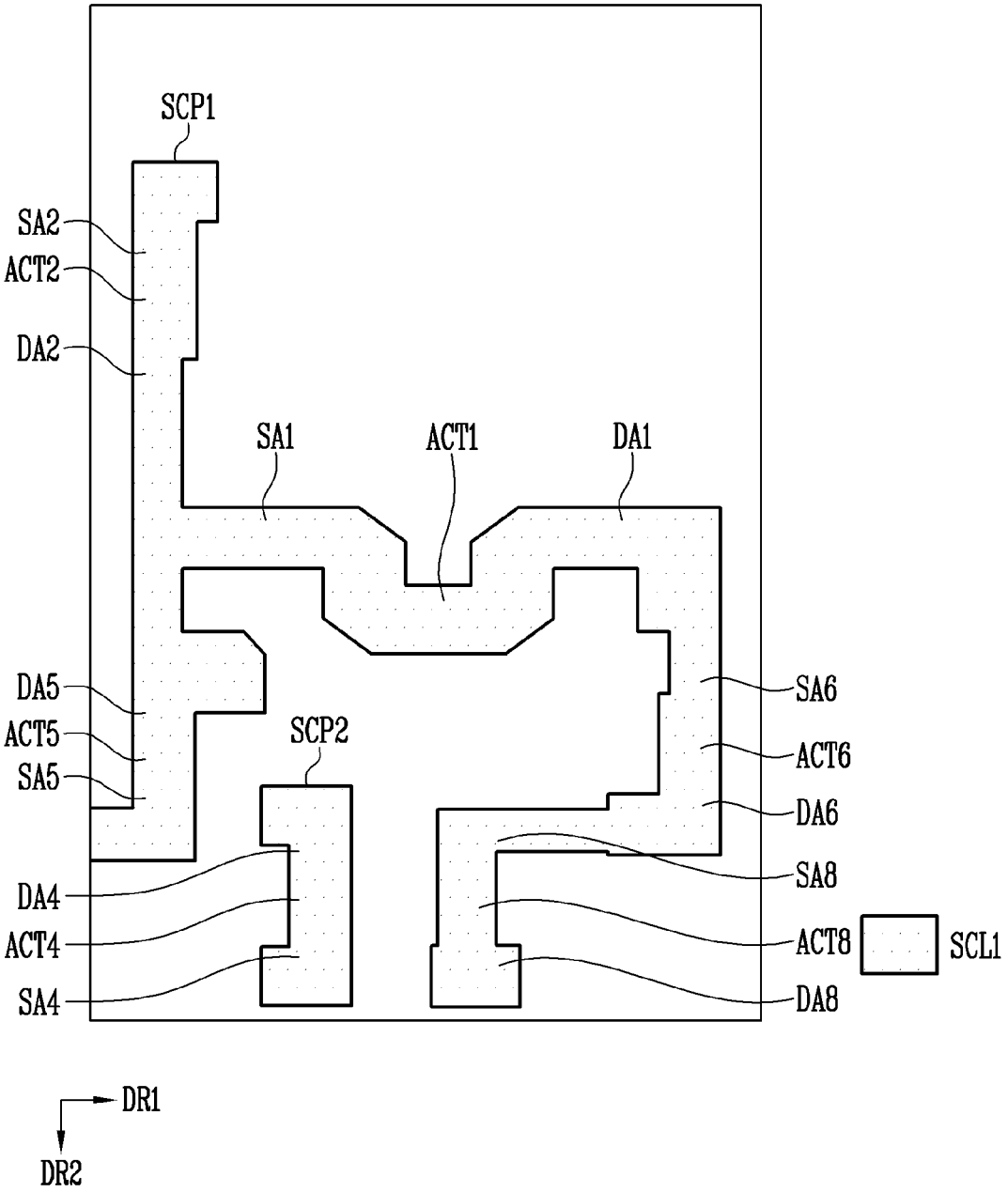
FIG. 9 is a plan view illustrating an example of a first semiconductor layer included in the backplane structure shown in FIG. 8.
Figure 10:
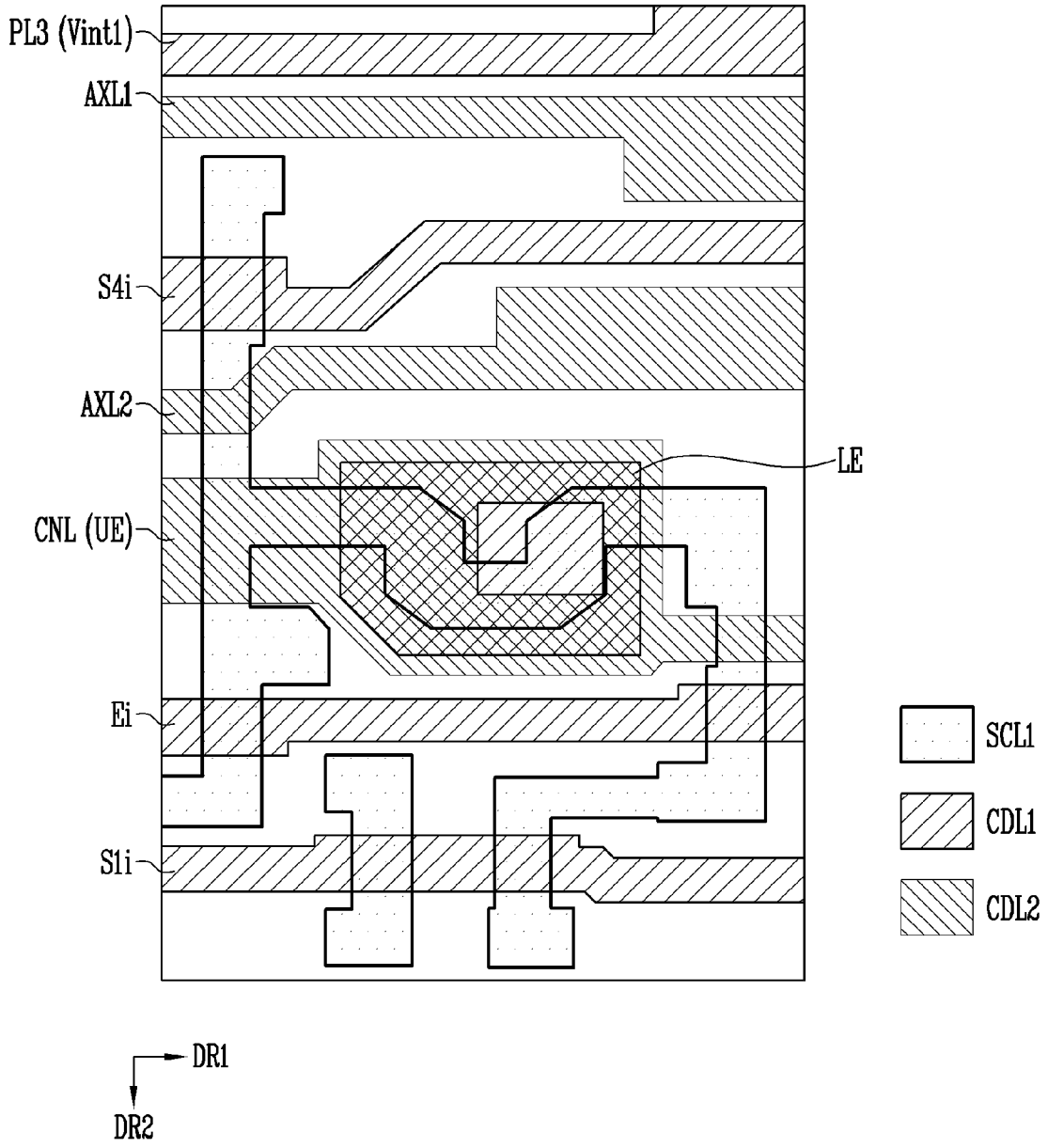
FIG. 10 is a plan view illustrating an example of a first conductive layer and a second conductive layer, which are included in the backplane structure shown in FIG. 8.
Figure 11:
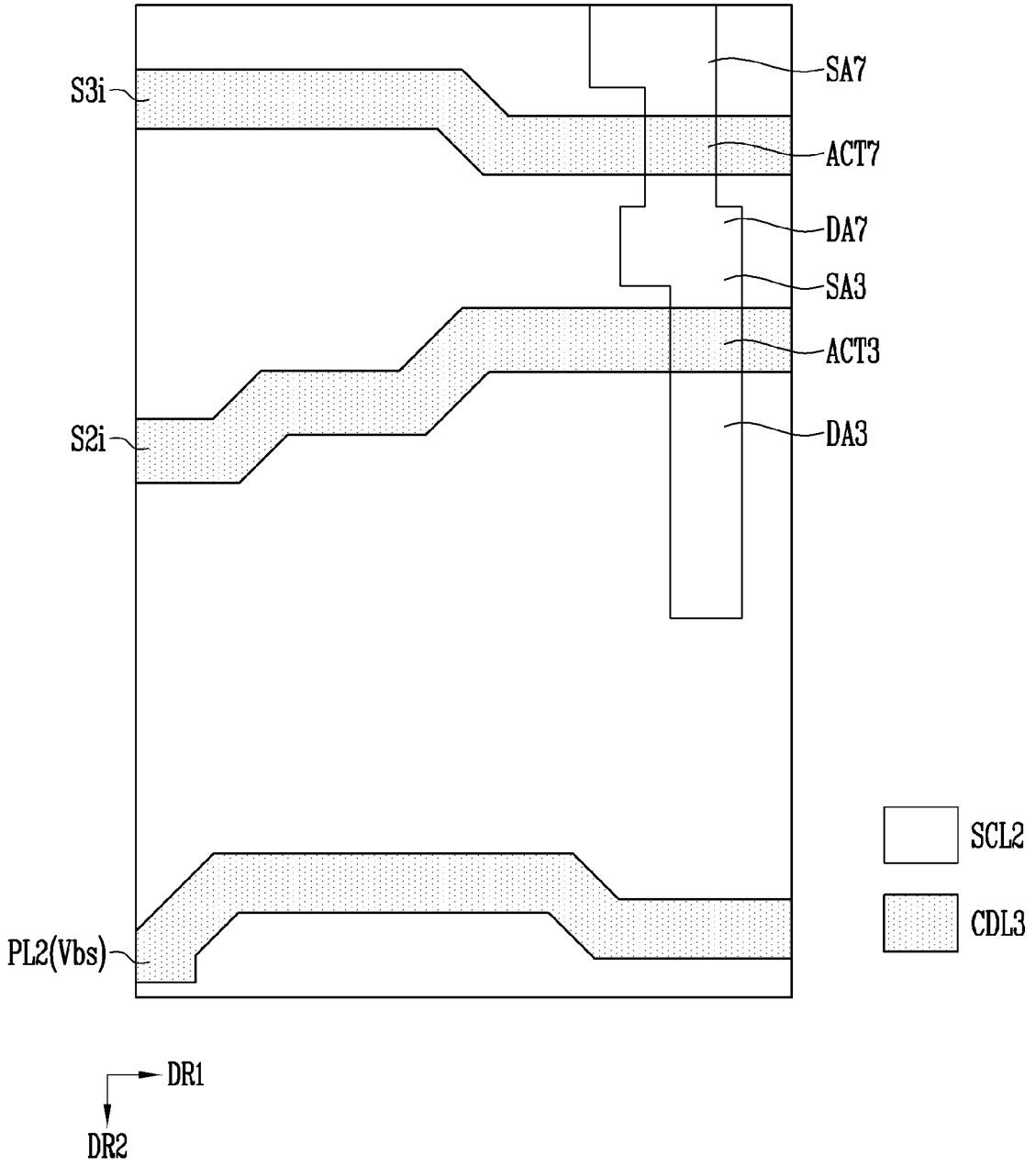
FIG. 11 is a plan view illustrating an example of a third conductive layer and a second semiconductor layer, which are included in the backplane structure shown in FIG. 8.
Figure 12:
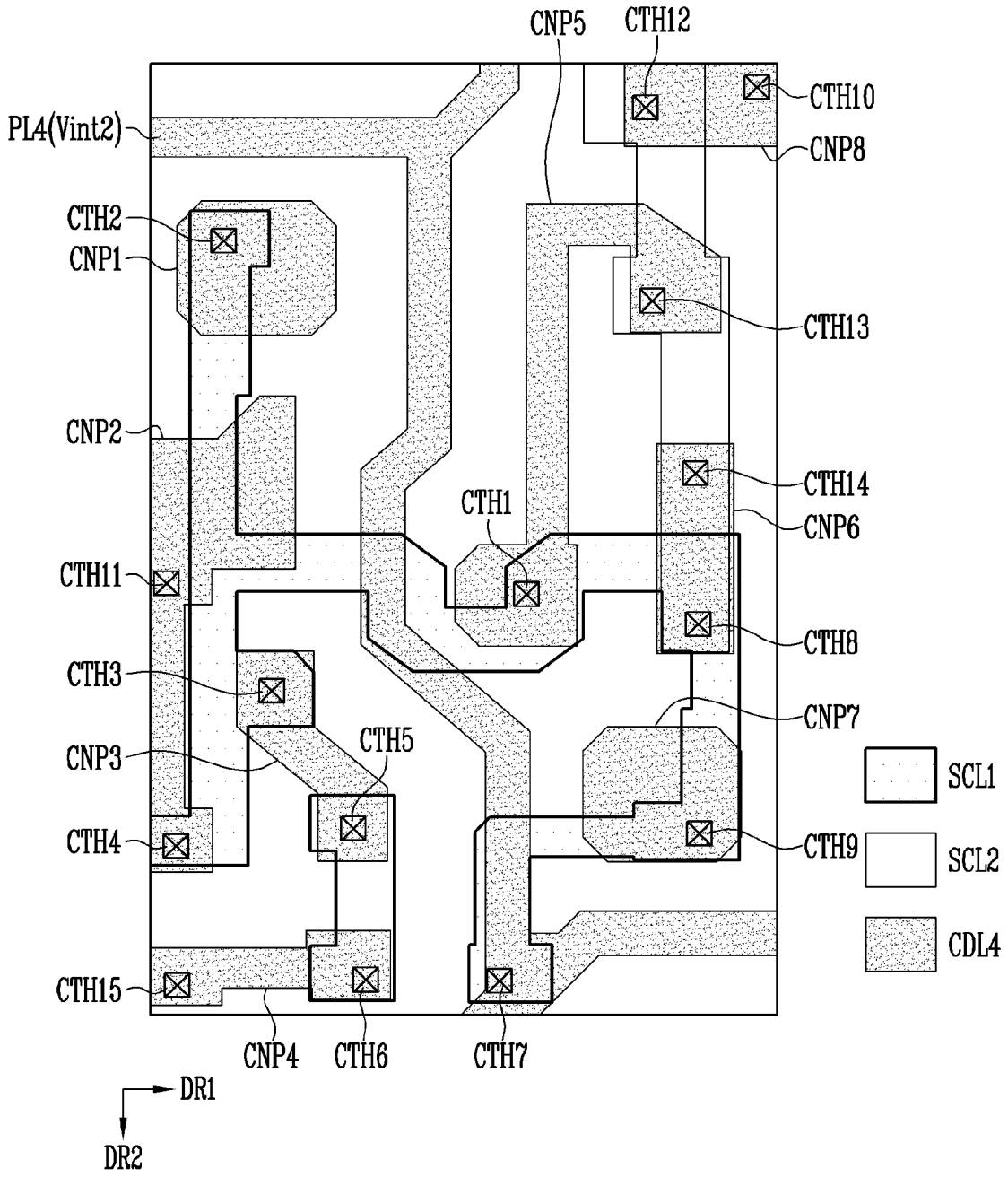
FIG. 12 is a plan view illustrating an example of the third conductive layer, the second conductive layer, and a fourth conductive layer, which are included in the backplane structure shown in FIG. 8.
Figure 13:
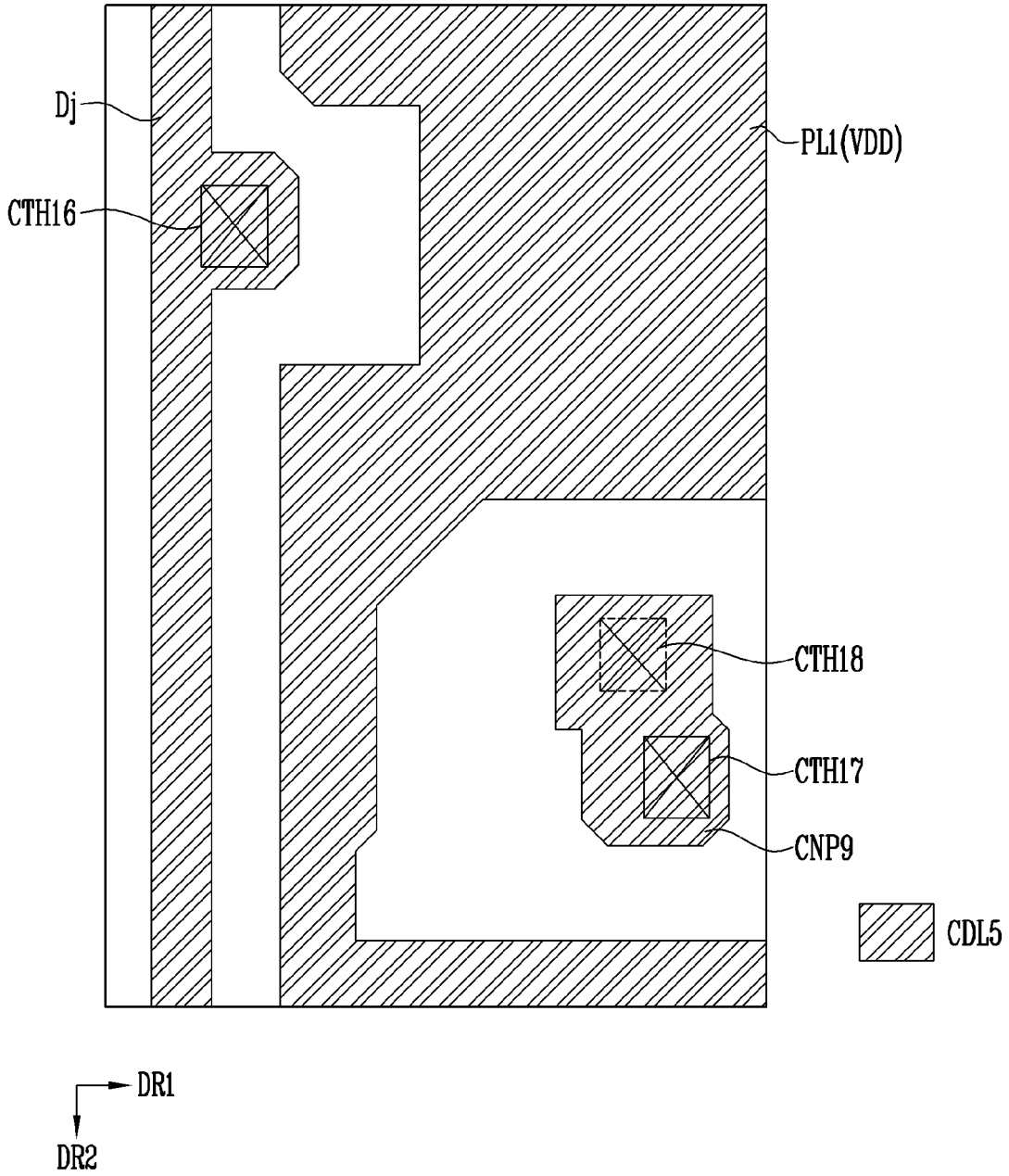
FIG. 13 is a plan view illustrating an example of a fifth conductive layer included in the backplane structure shown in FIG. 8.

FIG. 8 is a layout view illustrating an example of a backplane structure including the pixel circuit included in the pixel shown in FIG. 3. FIG. 9 is a plan view illustrating an example of a first semiconductor layer included in the backplane structure shown in FIG. 8. FIG. 10 is a plan view illustrating an example of a first conductive layer and a second conductive layer, which are included in the backplane structure shown in FIG. 8. FIG. 11 is a plan view illustrating an example of a third conductive layer and a second semiconductor layer, which are included in the backplane structure shown in FIG. 8. FIG. 12 is a plan view illustrating an example of the third conductive layer, the second conductive layer, and a fourth conductive layer, which are included in the backplane structure shown in FIG. 8. FIG. 13 is a plan view illustrating an example of a fifth conductive layer included in the backplane structure shown in FIG. 8.

In FIG. 8, the light emitting element LD is omitted for convenience of illustration.

Referring to FIGS. 3, 8, 9, 10, 11, 12, and 13, the backplane structure may include first to eighth transistors M1 to M8 and a storage capacitor Cst, which are included in a pixel circuit, and include various types of signal lines connected thereto.

A first semiconductor layer SCL1, a first conductive layer CDL1, a second conductive layer CDL2, a second semiconductor layer SCL2, a third conductive layer CDL3, a fourth conductive layer CDL4, and a fifth conductive layer CDL5 may be sequentially stacked on a base layer with predetermined insulating layers interposed therebetween.

As shown in FIGS. 9 and 10, the first semiconductor layer SCL may include a plurality of active regions ACT1, ACT2, ACT4, ACT5, ACT6, and ACT8, source regions SA1, SA2, SA4, SA5, SA6, and SA8, and drain regions DA1, DA2, DA4, DA5, DA6, and DA8. The first semiconductor layer SCL1 may be a poly-silicon semiconductor layer. For example, the first semiconductor layer SCL1 may be formed through a low temperature poly-silicon (LTPS) process.

Predetermined portions overlapping the first conductive layer CDL1 in the semiconductor layer SCL1 may be defined as first, second, fourth, fifth, sixth, and eight active regions ACT1, ACT2, ACT4, ACT5, ACT6, and ACT8. The first, second, fourth, fifth, sixth, and eight active regions ACT1, ACT2, ACT4, ACT5, ACT6, and ACT8 may correspond to the first, second, fourth, fifth, sixth, and eighth transistors M1, M2, M4, M5, M6, and M8.

First, second, fourth, fifth, sixth, and eighth source regions SA1, SA2, SA4, SA5, SA6, and SA8 may correspond to the first, second, fourth, fifth, sixth, and eighth transistors M1, M2, M4, M5, M6, and M8. First, second, fourth, fifth, sixth, and eighth drain regions DA1, DA2, DA4, DA5, DA6, and DA8 may correspond to the first, second, fourth, fifth, sixth, and eighth transistors M1, M2, M4, M5, M6, and M8.

One end of the first active region ACT1 may be connected to the first source region SA1, and the other end of the first active region ACT1 may be connected to the first drain region DA1. Relationships between the other active regions and the other source and drain regions may be similar to the relationship between the first active region ACT and the first source and drain regions SA1 and DA1.

The first active region ACT1 may have a shape extending in a first direction DR1, and have a shape bent a plurality of times along the extending length direction. The first active region ACT1 is formed long, so that a channel region of the first transistor M1 can be formed long. Accordingly, the driving range of a gate voltage applied to the first transistor M1 can be widened. In an embodiment, the first direction DR1 may be a direction substantially parallel to a horizontal direction or a pixel row.

In an embodiment, the first semiconductor layer SCL1 may include a first semiconductor pattern SCP1 and a second semiconductor pattern SCP2. The first semiconductor pattern SCP1 may include the first, second, fifth, and sixth active regions ACT1, ACT2, ACT5, and ACT6.

The second semiconductor pattern SCP2 may be spaced apart from the first semiconductor pattern SCP1. For example, the second semiconductor pattern SCP2 may be separated from the first semiconductor pattern SCP1. The second semiconductor pattern SCP2 may be disposed in an island shape. The second semiconductor pattern SCP2 may include the fourth active region ACT4, the fourth drain region DA4, and the fourth source region SA4.

That is, the second semiconductor pattern SCP2 may be spaced apart from the first semiconductor pattern SCP1 so as to maximize a design space and a design process in the pixel circuit implementing the first to eighth transistors M1 to M8 by using the first semiconductor layer SCL1 and the second semiconductor layer SCL2.

The first conductive layer CDL1 may be formed on a first gate insulating layer covering at least a portion of the first semiconductor layer SCL1. As shown in FIG. 10, the first conductive layer CDL1 may include a lower electrode LE of the storage capacitor Cst, a first scan line S1*i*, a fourth scan line S4*i*, an emission control line Ei, and a third power line PL3.

In an embodiment, portions of the first conductive layer CDL1, which overlaps the first semiconductor layer SCL1, may be respectively gate electrodes of transistors (e.g., M1, M2, M4, M5, M6, and M8) corresponding thereto. The lower electrode LE of the storage capacitor Cst, the first scan line S1*i*, the fourth scan line S4*i*, the emission control line Ei, the third power line PL3, and the gate electrodes may be formed of the same material in the same layer through the same process.

The third power line PL3 may transfer the voltage of the first initialization power source Vint1.

The first scan line S1*i*, the fourth scan line S4*i*, the emission control line Ei, and the third power line PL3 may extend in the first direction DR1.

The second conductive layer CDL2 may be formed on a first insulating layer covering at least a portion of the first conductive layer CDL1. As shown in FIG. 10, the second conductive layer CDL2 may include a connection line CNL including an upper electrode UE of the storage capacitor Cst, a first auxiliary line AXL1, and a second auxiliary line AXL2. The connection line CNL, the first auxiliary line AXL1, and the second auxiliary line AXL2 may extend in the first direction DR1. In an embodiment, the connection line CNL, the first auxiliary line AXL1, and the second auxiliary line AXL2 may be formed of the same material in the same layer through the same process.

The voltage of the first driving power source VDD may be provided to the connection line CNL. In addition, the upper electrode UE may be provided while overlapping the lower electrode LE. Therefore, the storage capacitor Cst may be formed by the lower electrode LE and the upper electrode UE with the first insulating layer interposed therebetween.

In an embodiment, an area of the upper electrode UE may be greater than an area of the lower electrode LE. In an embodiment, the upper electrode UE may include an opening at a portion of a fifth connection pattern CNP5 overlapping therewith.

The first auxiliary line AXL1 may overlap a third scan line S3*i*. In an embodiment, the first auxiliary line AXL1 may overlap an active region (e.g., a seventh active region ACT7) of the seventh transistor M7. The first auxiliary line AXL1 may stabilize an operation characteristic of the seventh transistor M7 as an oxide semiconductor transistor by blocking light incident onto the seventh active region ACT7. However, this is merely illustrative, and the first auxiliary line AXL1 may serve as an auxiliary gate electrode and an auxiliary scan line with respect to the seventh transistor M7 according to embodiments.

The second auxiliary line AXL2 may overlap a second scan line S2*i*. In an embodiment, the second auxiliary line AXL2 may overlap an active region (e.g., a third active region ACT3) of the third transistor M3. The second auxiliary line AXL2 may stabilize an operation characteristic of the third transistor M3 as an oxide semiconductor transistor by blocking light incident onto the third active region ACT3. However, this is merely illustrative, and the second auxiliary line AXL2 may serve as an auxiliary gate electrode and an auxiliary scan line with respect to the third transistor M3 according to embodiments.

The second semiconductor layer SCL2 may be formed on a second insulating layer covering at least a portion of the second conductive layer CDL2. As shown in FIG. 11, the second semiconductor layer SCL2 may include the third and seventh active regions ACT3 and ACT7, third and seventh source regions SA3 and SA7, and third and seventh drain regions DA3 and DA7. The second semiconductor layer SCL2 may include an oxide semiconductor layer.

The third and seventh active regions ACT3 and ACT7 may overlap the third conductive layer CDL3. The third and seventh active regions ACT3 and ACT7 may respectively correspond to the third and seventh transistors M3 and M7.

The third and seventh source regions SA3 and SA7 may respectively correspond to the third and seventh transistors M3 and M7. The third and seventh drain regions DA3 and D7 may respectively correspond to the third and seventh transistors M3 and M7.

The third conductive layer CDL3 may be formed on a second gate insulating layer covering at least a portion of the first semiconductor layer SCL1. As shown in FIG. 11, the third conductive layer CDL3 may include the second scan line S2*i*, the third scan line S3*i*, and a second power line PL2.

In an embodiment, portions of the third conductive layer CDL3, which overlaps the second semiconductor layer SCL2, may be respectively gate electrodes of transistors (e.g., M3 and M7) corresponding thereto.

The second power line PL2 may transfer the voltage of the first power source Vbs.

The second scan line S2*i*, the third scan line S3*i*, and the second power line PL2 may extend in the first direction DR1.

The fourth conductive layer CDL4 may be formed on a third insulating layer covering at least a portion of the third conductive layer CDL3. As shown in FIG. 12, the fourth conductive layer CDL4 may include a fourth power line PL4 and first to eight connection patterns CNP1 to CNP8. In an embodiment, the fourth power line PL4 and the first to eight connection patterns CNP1 to CNP8 may be formed of the same material in the same layer through the same process.

The fourth power line PL4 may extend while traversing the pixel 10 in the first direction DR1 and a second direction DR2. The fourth power line PL4 may transfer the voltage of the second initialization power source Vint2.

The fourth power line PL4 may be connected to the eighth drain region DA8 of the first semiconductor layer SCL1 through a seventh contact hole CTH7. Therefore, the voltage of the second initialization power source Vint2 may be provided to the eighth transistor M8.

The first connection pattern CNP1 may mediate connection between a data line Dj and the second transistor M2. For example, the first connection pattern CNP1 may be connected to the second source region SA2 of the first semiconductor layer SCL1 through a second contact hole CTH2.

The second connection pattern CNP2 may mediate connection between the first driving power source VDD and the fifth transistor M5 through the upper electrode UE of the storage capacitor Cst. The second connection pattern CNP2 may be connected to the connection line CNL including the upper electrode UE through an eleventh contact hole CTH11. The upper electrode UE is connected to the first driving power source VDD, and hence, the first driving power source VDD may be transferred to the second connection pattern CNP2.

Also, the second connection pattern CNP2 may be connected to the fifth source region SA5 of the first semiconductor layer SCL1 through a fourth contact hole CTH4. Therefore, the voltage of the first driving power source VDD may be provided to the fifth transistor M5 through the second connection pattern CNP2.

The third connection pattern CNP3 may connect the fourth transistor M4 and the fifth transistor M5 to each other. In an embodiment, the third connection pattern CNP3 may be connected to the fifth drain region DA5 of the first semiconductor layer SCL1 through a third contact hole CTH3, and connected to the fourth drain region DA4 of the first semiconductor layer SCL1 through a fifth contact hole CTH5. For example, the third connection pattern CNP3 may serve as the first node N1 on the circuit diagram shown in FIG. 3.

The fourth connection pattern CNP4 may connect the fourth transistor M4 and the second power line PL2 to each other. In an embodiment, the fourth connection pattern CNP4 may be connected to the fourth source region SA4 of the first semiconductor layer SCL1 through a sixth contact hole CTH6, and connected to the second power line PL2 through a fifteenth contact hole CTH15. Therefore, the voltage of the first power source Vbs may be provided to the fourth transistor M4.

The fifth connection pattern CNP5 may connect the lower electrode LE of the storage capacitor Cst and the seventh transistor M7. In an embodiment, the fifth connection pattern CNP5 may be connected to the lower electrode LE through a first contact hole CTH1, and connected to the seventh drain region DA7 of the second semiconductor layer SCL2 through a thirteenth contact hole CTH13.

The sixth connection pattern CNP6 may connect the third transistor M3 and the first transistor M1 to each other. In an embodiment, the sixth connection pattern CNP6 may be connected to the first drain region DA1 of the first semiconductor layer SCL1 through an eight contact hole CTH8, and connected to the third drain region DA3 of the second semiconductor layer SCL2 through a fourteenth contact hole CTH14.

The seventh connection pattern CNP7 may mediate connection between the sixth transistor M6 and the light emitting element LD. The seventh connection pattern CNP7 may be connected to the sixth drain region DA6 of the first semiconductor layer SCL1 through a ninth contact hole CTH9. Also, the seventh connection pattern CNP7 may be connected to a ninth connection pattern CNP9 through a seventeenth contact hole CTH17. The ninth connection pattern CNP9 may be connected to a first electrode of the light emitting element LD on the top thereof through an eighteenth contact hole CTH18.

The eight connection pattern CNP8 may connect the seventh transistor M7 and the third power line PL3 to each other. In an embodiment, the eighth connection pattern CNP8 may be connected to the third power line PL3 through a tenth contact hole CTH10, and connected to the seventh source region SA7 of the second semiconductor layer SCL2 through a twelfth contact hole CTH12. Therefore, the voltage of the first initialization power source Vint1 may be provided to the seventh transistor M7.

The fifth conductive layer CDL5 may be formed on a fourth insulating layer covering at least a portion of the fourth conductive layer CDL4. As shown in FIG. 13, the fifth conductive layer CDL5 may include a first power line PL1, the data line Dj, and the ninth connection pattern CNP9. In an embodiment, the first power line PL1, the data line Dj, and the ninth connection pattern CNP9 may be formed of the same material in the same layer through the same process.

The first power line PL1 may have the widest area among the conductive patterns, and extend in the second direction DR2. In FIG. 13, only a portion of the first power source PL1 is illustrated, and the first power line PL1 may be connected to the connection line CNL through a predetermined contact hole existing at a certain portion. Accordingly, the voltage of the first driving power source VDD may be provided to the pixel 10.

The data line Dj may extend in the second direction DR2, and provide a data signal. The data line Dj may be connected to the first connection pattern CNP1 through a sixteenth contact hole CTH16. Therefore, the data signal may be provided to the second source region of the second transistor M2 via the data line Dj and the first connection pattern CNP1.

The ninth connection pattern CNP9, along with the seventh connection pattern CNP7 overlapping therewith, may mediate connection between the sixth transistor M6 and the light emitting element LD. In an embodiment, the ninth connection pattern CNP9 may be connected to the seventh connection pattern CNP7 through the seventeenth contact hole CTH17, and connected to the first electrode of the light emitting element LD on the top thereof through the eighteenth contact hole CTH18.

The circuit of the pixel shown in FIG. 3 can be implemented by the layout structure of the conductive layers CDL1 to CDL5 and the semiconductor layers SCL1 and SCL2, which are described above.

Figure 14:
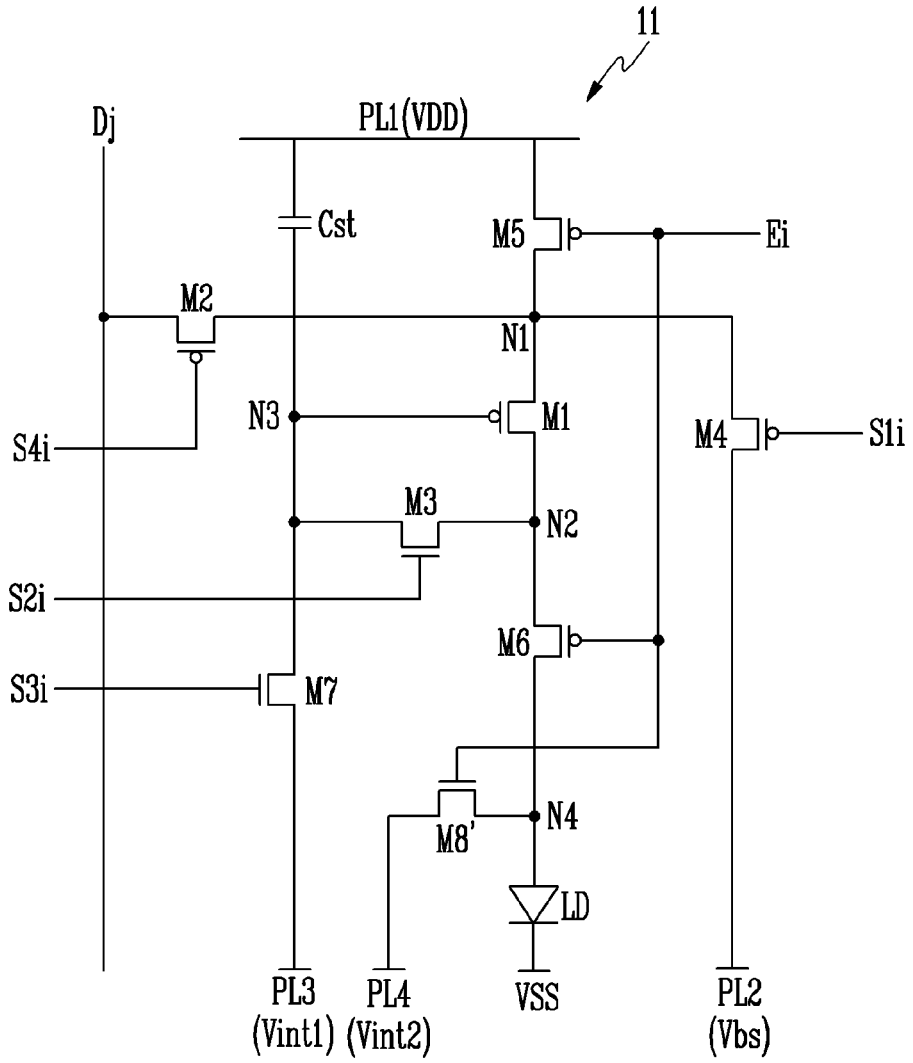
FIG. 14 is a circuit diagram illustrating an example of the pixel included in the display device shown in FIG. 1.

FIG. 14 is a circuit diagram illustrating an example of the pixel included in the display device shown in FIG. 1.

In FIG. 14, components identical to those described with reference to FIG. 3 are designated by like reference numerals, and for convenience of explanation, their overlapping descriptions will be omitted. In addition, a pixel 11 shown in FIG. 14 may have a configuration substantially identical or similar to that of the pixel 10 shown in FIG. 3, except an eighth transistor M8', and for convenience of explanation, a repeated description of identical or similar components and technical aspects previously described will be omitted.

Referring to FIG. 14, the pixel 11 may include a light emitting element LD, first to eighth transistors M1 to M8', and a storage capacitor Cst.

The eighth transistor M8' may be connected between a first electrode of the light emitting element LD (e.g., a fourth node N4) and a fourth power line PL4. In an embodiment, a gate electrode of the eighth transistor M8' may be connected to an emission control line Ei.

The eighth transistor M8' may be formed as an oxide semiconductor transistor. For example, the eighth transistor M8' may be an N-type oxide semiconductor transistor. Therefore, types of the eighth transistor M8' and the fifth transistor M5 may be different from each other.

The eighth transistor M8' may be turned on when the emission control signal is supplied to the emission control line Ei, to supply the voltage of the second initialization power source Vint2 to the first electrode of the light emitting element LD. That is, the eighth transistor M8' may be turned on or turned off on the contrary to the fifth and sixth transistors M5 and M6. For example, the eighth transistor M8' may maintain the turn-on state in a non-emission period.

When the eighth transistor M8' is replaced with an N-type transistor, the eighth transistor M8' can be controlled by using the emission control signal, and a turn-off voltage of the eighth transistor M8' can be applied as a voltage lower than 0 V. Thus, power consumption may be reduced. Further, current leakage of a path on which the eighth transistor M8' as the oxide semiconductor transistor is disposed can be reduced.

Figure 15:
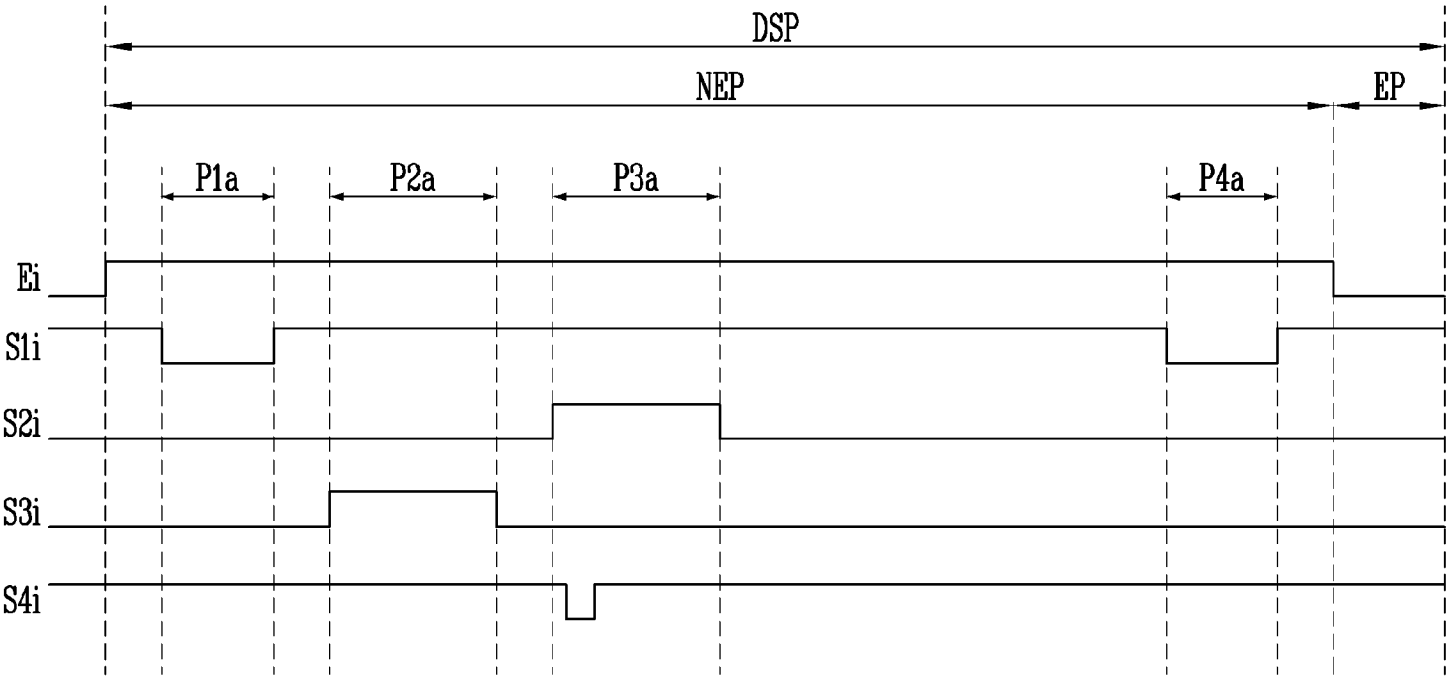
FIG. 15 is a timing diagram illustrating an example of signals supplied to the pixel shown in FIG. 14.

FIG. 15 is a timing diagram illustrating an example of signals supplied to the pixel shown in FIG. 14.

Referring to FIGS. 14 and 15, in a non-emission period NEP of a display scan period DSP, the first scan signal, the third scan signal, and the second scan signal may be sequentially supplied to the first scan line S1*i*, the third scan line S3*i*, and the second scan line S2*i*. The first scan signal may be supplied to the first scan line S1*i* a plurality of times in the non-emission period NEP. The fourth scan signal may be supplied to the fourth scan line S4*i* while the second scan signal is supplied.

Although a case where the first to third scan signals do not overlap each other is illustrated in FIG. 15, this is merely illustrative, and at least some of the first to third scan signals may overlap each other according to embodiments. In addition, pulse widths of the first to third scan signals may also be freely set according to an applied condition as long as a driving purpose is not changed.

In a first period P1*a*, the first scan signal may be supplied to the first scan line S1*i*, and the fourth transistor M4 may be turned on. Accordingly, the first transistor M1 may be on-biased.

In a second period P2*a*, the third scan signal may be supplied to the third scan line S3*i*, and the seventh transistor M7 may be turned on. Accordingly, a gate voltage of the first transistor M1 may be initialized to the voltage of the first initialization power source Vint1.

In a third period P3*a*, the second scan signal may be supplied to the second scan line S2*i*, and the third transistor M3 may be turned on. Accordingly, a threshold voltage of the first transistor M1 can be compensated. Also, in the third period P3*a*, the fourth scan signal may be supplied to the fourth scan line S4*i*, and the second transistor M2 may be turned on. Therefore, a data signal may be written.

In a fourth period P4*a*, the first scan signal may be again supplied to the first scan line S1*i*, and the fourth transistor M4 may be turned on. Accordingly, the first transistor M1 may be again set to the on-bias state.

During the non-emission period NEP, the eighth transistor M8' may maintain the turn-on state.

However, this is merely illustrative. For example, according to embodiments, the signals described with reference to FIGS. 4 and 5 may be supplied to the pixel 11 shown in FIG. 14 as they are. As described with reference to FIGS. 3 and 4, the hysteresis characteristic may be additionally improved by turning on the third transistor M3 in a state in which the fourth transistor M4 is turned on to apply the on-bias to the first transistor Ml, so that the step efficiency can be increased.

Further, the kickback phenomenon occurring in the gate voltage of the first transistor M1 can be eliminated, minimized or reduced by turning on the third transistor M3 (e.g., the second scan signal and the third scan signal overlap each other) in a state in which the seventh transistor M7 is turned on to initialize the gate voltage of the first transistor Ml. In addition, the signals described with reference to FIG. 6 or 7 may be applied to the pixel 11 shown in FIG. 14.

Figure 16:
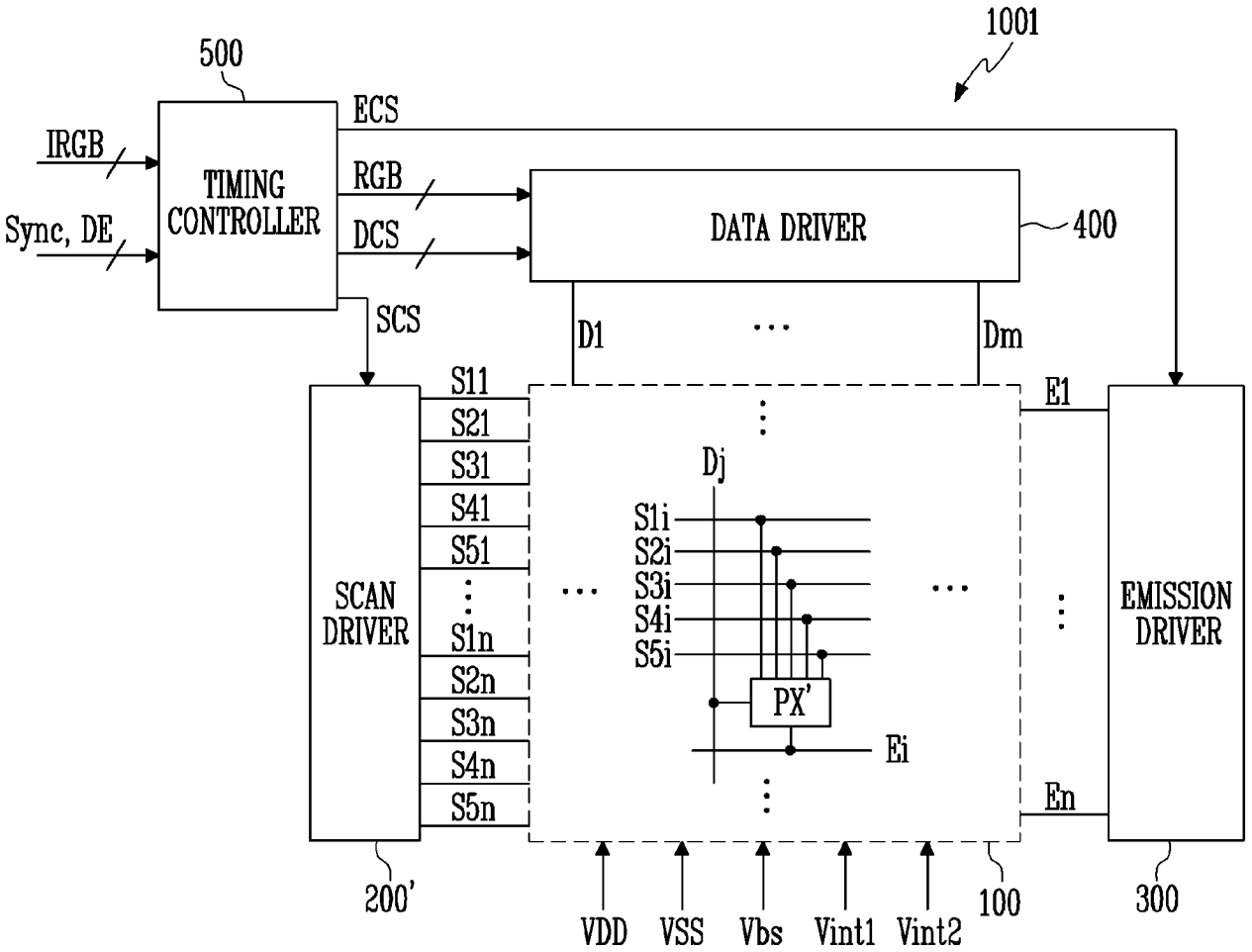
FIG. 16 is a diagram illustrating an example of the display device.

FIG. 16 is a diagram illustrating an example of the display device.

In FIG. 16, components identical to those described with reference to FIG. 1 are designated by like reference numerals, and for convenience of explanation, their overlapping descriptions will be omitted.

Referring to FIG. 16, a display device 1001 may include a pixel portion 100, a scan driver 200', an emission driver 300, a data driver 400, and a timing controller 500.

The pixel portion 100 may include scan lines S11 to S1*n*, S21 to S2*n*, S31 to S3*n*, S41 to S4*n*, and S51 to S5*n*, emission control lines E1 to En, and data lines D1 to Dm, and include pixels PX' connected to the scan lines S11 to S1*n*, S21 to S2*n*, S31 to S3*n*, S41 to S4*n*, and S51 to S5*n*, the emission control lines E1 to En, and the data lines D1 to Dm.

The scan driver 200' may supply a first scan signal, a second scan signal, a third scan signal, a fourth scan signal, and a fifth scan signal respectively to first scan lines S11 to S1*n*, second scan lines S21 to S2*n*, third scan lines S31 to S3*n*, fourth scan lines S41 to S4*n*, and fifth scan lines S51 to S5*n*, based on a first control signal SCS.

In an embodiment, the fifth scan signal may have a reversed waveform of the first scan signal.

In an embodiment, the scan driver 200' may include five scan drivers (scan driving circuits) for respectively outputting the first scan signal, the second scan signal, the third scan signal, the fourth scan signal, and the fifth scan signal. Alternatively, the scan driver 200' may generate the fifth scan signal through a component for reversing the first scan signal.

Figure 17:
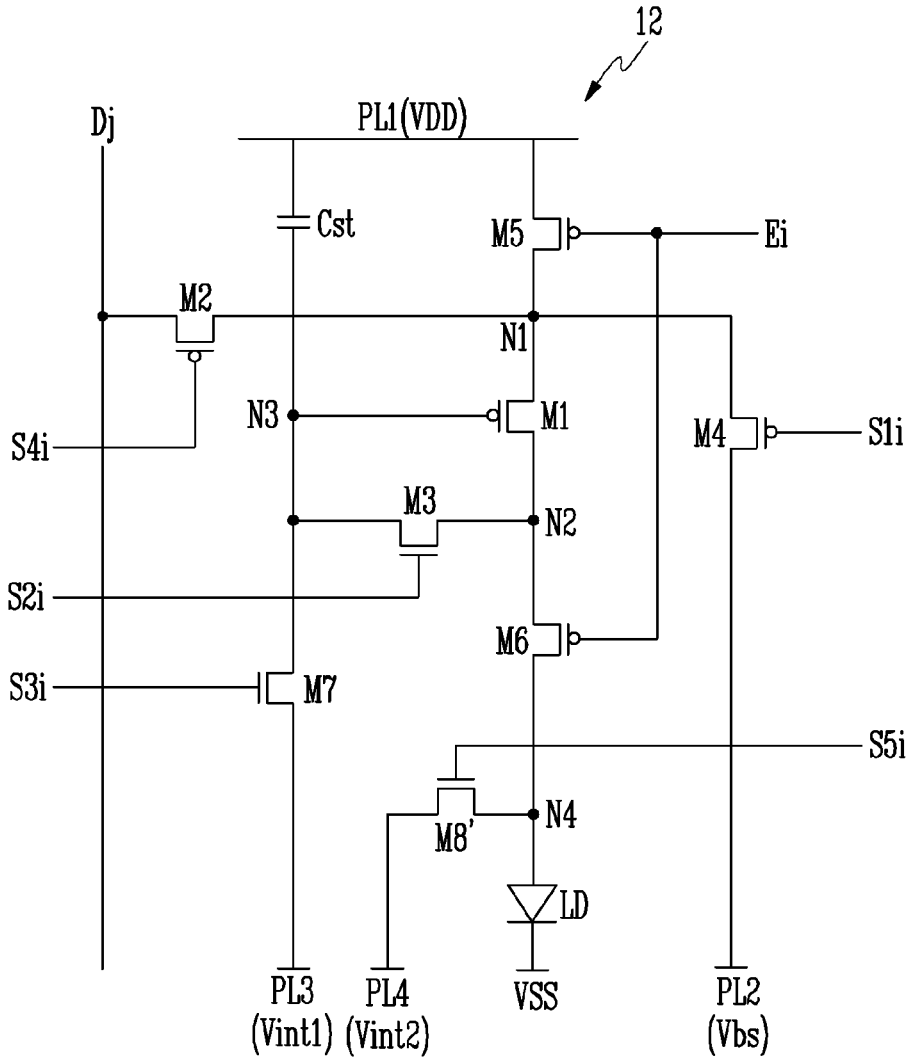
FIG. 17 is a circuit diagram illustrating an example of a pixel included in the display device shown in FIG. 16.

FIG. 17 is a circuit diagram illustrating an example of the pixel included in the display device shown in FIG. 16.

In FIG. 17, components identical to those described with reference to FIG. 14 are designated by like reference numerals, and for convenience of explanation, their overlapping descriptions will be omitted. In addition, a pixel 12 shown in FIG. 17 may have a configuration identical or similar to that of the pixel 11 shown in FIG. 14, except an eighth transistor M8' and driving thereof, and for convenience of explanation, a further description of elements and technical aspects previously described is omitted.

Referring to FIG. 17, the pixel 12 may include a light emitting element LD, first to eighth transistors M1 to M8', and a storage capacitor Cst.

The eighth transistor M8' may be connected between a first electrode of the light emitting element LD (e.g., a fourth node N4) and a fourth power line PL4. In an embodiment, a gate electrode of the eighth transistor M8' may be connected to an ith fifth scan line S5*i* (hereinafter, referred to as a fifth scan line).

The eighth transistor M8' may be formed as an oxide semiconductor transistor. For example, the eighth transistor M8' may be an N-type oxide semiconductor transistor.

The eighth transistor M8' may be turned on when the emission control signal is supplied to the fifth scan line S5*i*, to supply the voltage of the second initialization power source Vint2 to the first electrode of the light emitting element LD.

As compared with the pixel 11 shown in FIG. 14, the pixel 12 shown in FIG. 17 may independently control the eighth transistor M8'.

Figure 18:
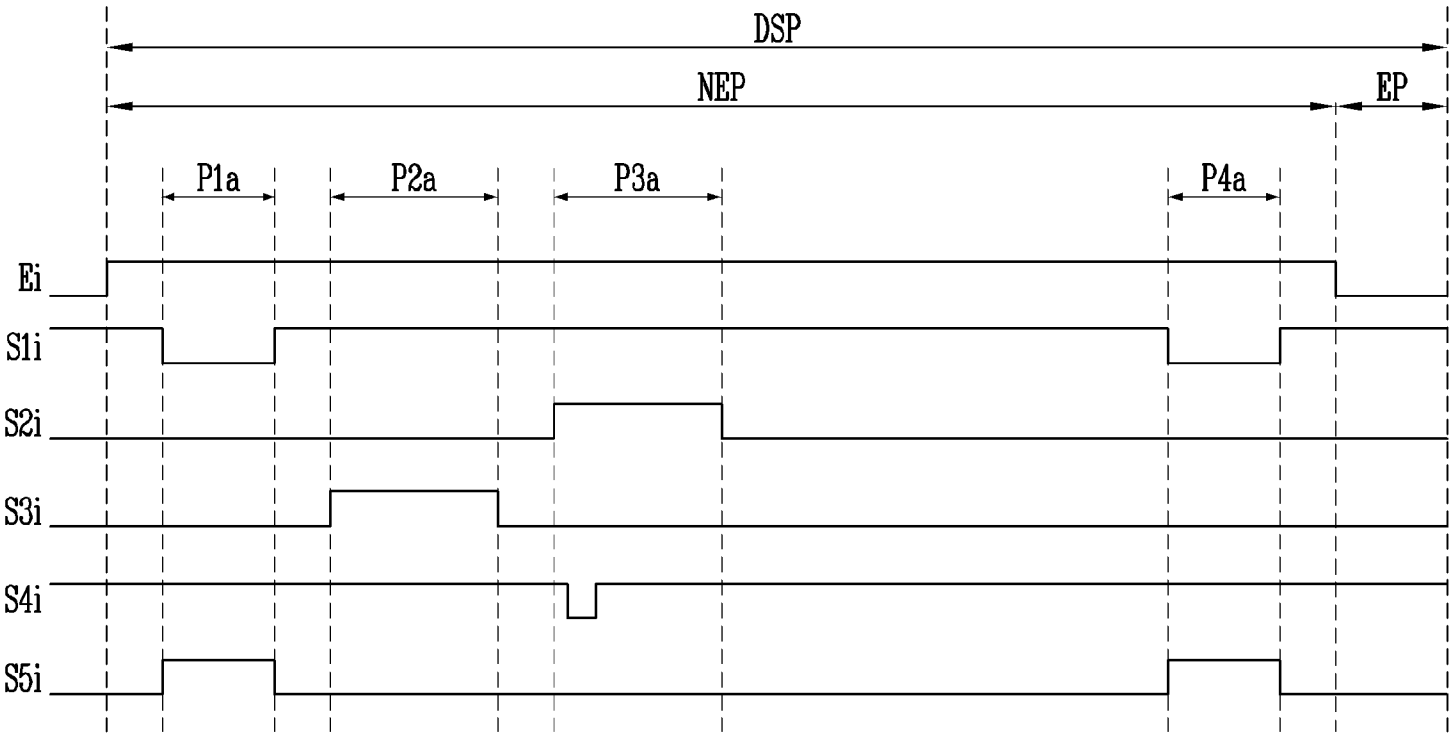
FIG. 18 is a timing diagram illustrating an example of signals supplied to the pixel shown in FIG. 17.

FIG. 18 is a timing diagram illustrating an example of signals supplied to the pixel shown in FIG. 17.

The timing diagram shown in FIG. 18 is substantially identical to the timing diagram shown in FIG. 15 and an operation according thereto, except the fifth scan signal supplied to the fifth scan line S5*i*, and for convenience of explanation, overlapping descriptions will be omitted.

Referring to FIGS. 17 and 18, in a non-emission period NEP of a display scan period DSP, the first scan signal, the third scan signal, and the second scan signal may be sequentially supplied to the first scan line S1*i*, the third scan line S3*i*, and the second scan line S2*i*. The first scan signal may be supplied to the first scan line S1*i* a plurality of times in the non-emission period NEP. The fourth scan signal may be supplied to the fourth scan line S4*i* while the second scan signal is supplied.

In an embodiment, the fifth scan signal may be supplied in a first period P1*a* and a fourth period P4*a*. The eighth transistor M8' may be turned on in the first period P1*a* and the fourth period P4*a* in response to the fifth scan signal supplied to the fifth scan line S5*i*. Therefore, the voltage of the second initialization power source Vint2 may be supplied to the fourth node N4 in the first period P1*a* and the fourth period P4*a*.

Figure 19:
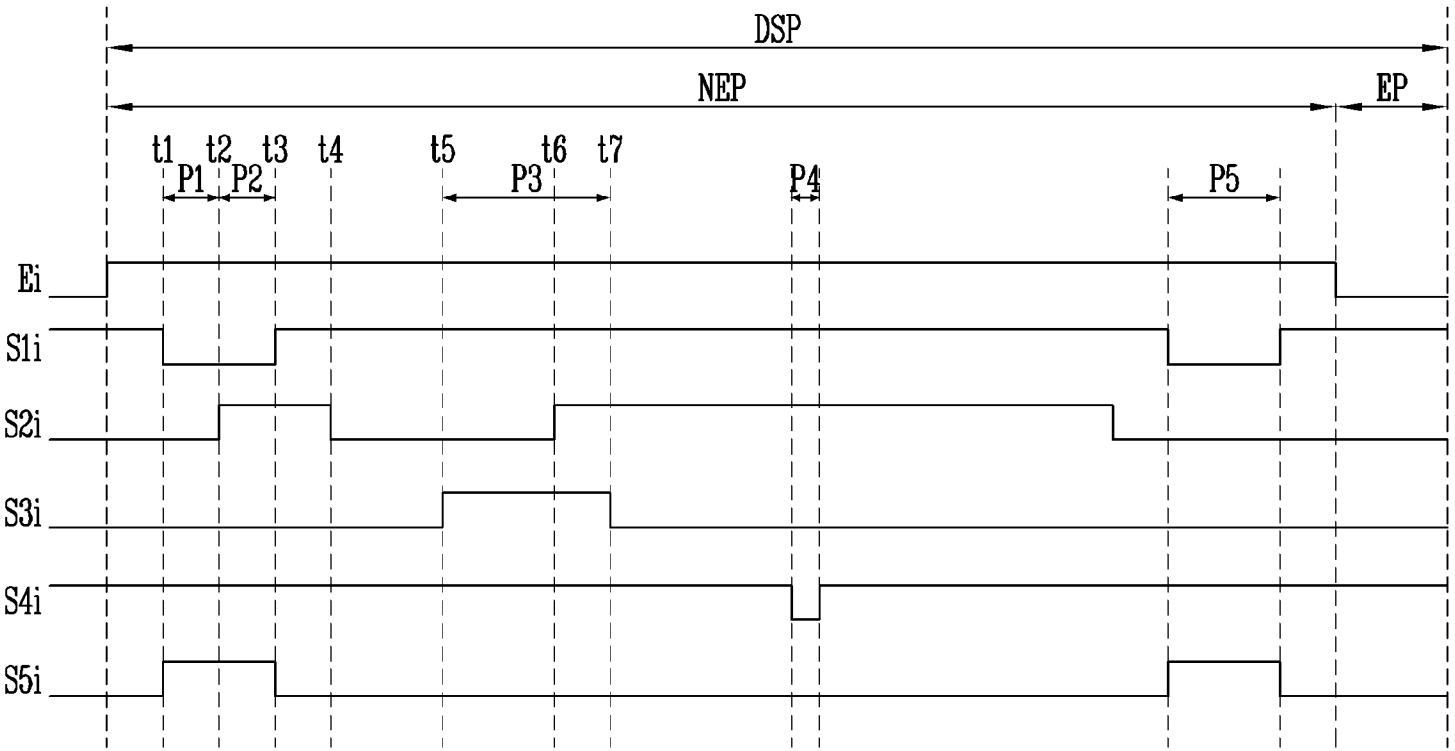
FIG. 19 is a timing diagram illustrating an example of the signals supplied to the pixel shown in FIG. 17.
Figure 20:
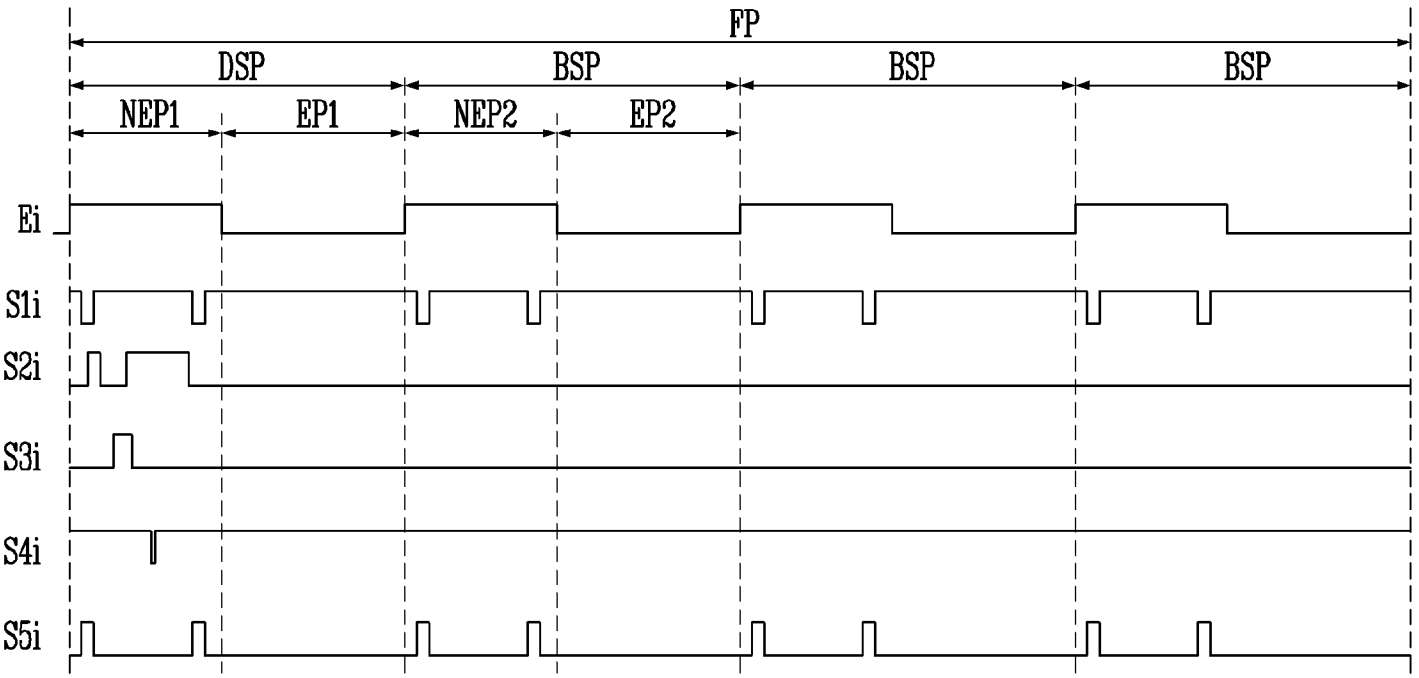
FIG. 20 is a timing diagram illustrating an example of the signals supplied to the pixel shown in FIG. 17 during one frame period.

FIG. 19 is a timing diagram illustrating an example of the signals supplied to the pixel shown in FIG. 17. FIG. 20 is a timing diagram illustrating an example of the signals supplied to the pixel shown in FIG. 17 during one frame period.

In FIGS. 19 and 20, for convenience of explanation, descriptions of portions overlapping those described with reference to FIGS. 4 and 5 will be omitted. In addition, portions of FIGS. 19 and 20 are identical or similar to the signals and the operation of the pixel, which are described with reference to FIGS. 4 and 5, except the fifth scan signal.

Referring to FIGS. 17, 19, and 20, in variable frequency driving for controlling a frame frequency, one frame period FP may include a display scan period DSP and at least one bias scan period BSP.

The eighth transistor M8' is an N-type transistor, and hence, the scan signals supplied to the fourth transistor M4 and the eighth transistor M8' may be separated from each other. For example, the fifth scan signal supplied to the eighth transistor M8' may be a reversed signal of the first scan signal. Therefore, the fourth transistor M4 and the eighth transistor M8' may be substantially simultaneously turned on.

Accordingly, the operation of the pixel 12 according to the timing diagrams shown in FIGS. 18 and 19 may be substantially identical to the operation of the pixel 10 according to the timing diagrams shown in FIGS. 4 and 5. In some embodiments, the second scan signal may be supplied as one continuous pulse as shown in FIGS. 6 and 7 so as to reduce power consumption.

Figure 21A:
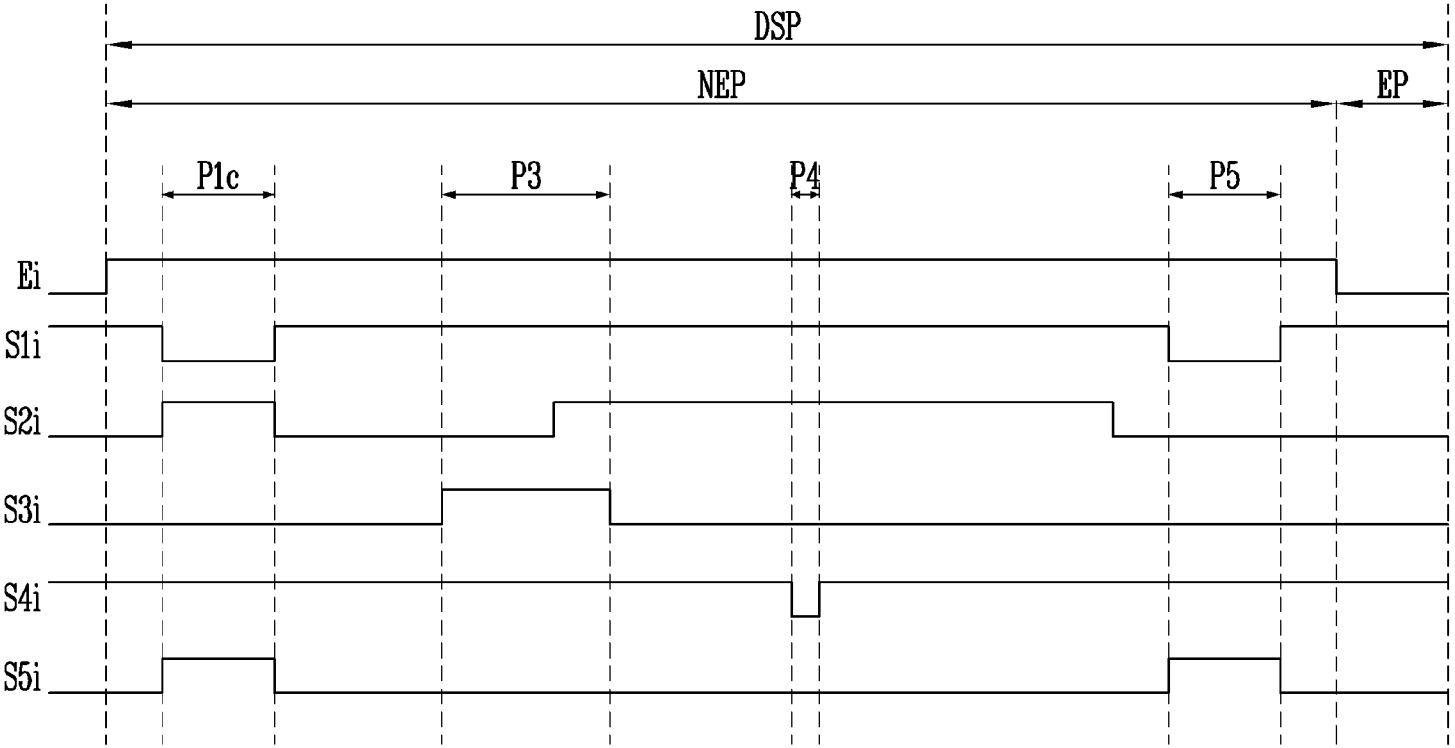
FIGS. 21A and 21B are timing diagrams illustrating examples of the signals supplied to the pixel shown in FIG. 17.
Figure 21B:
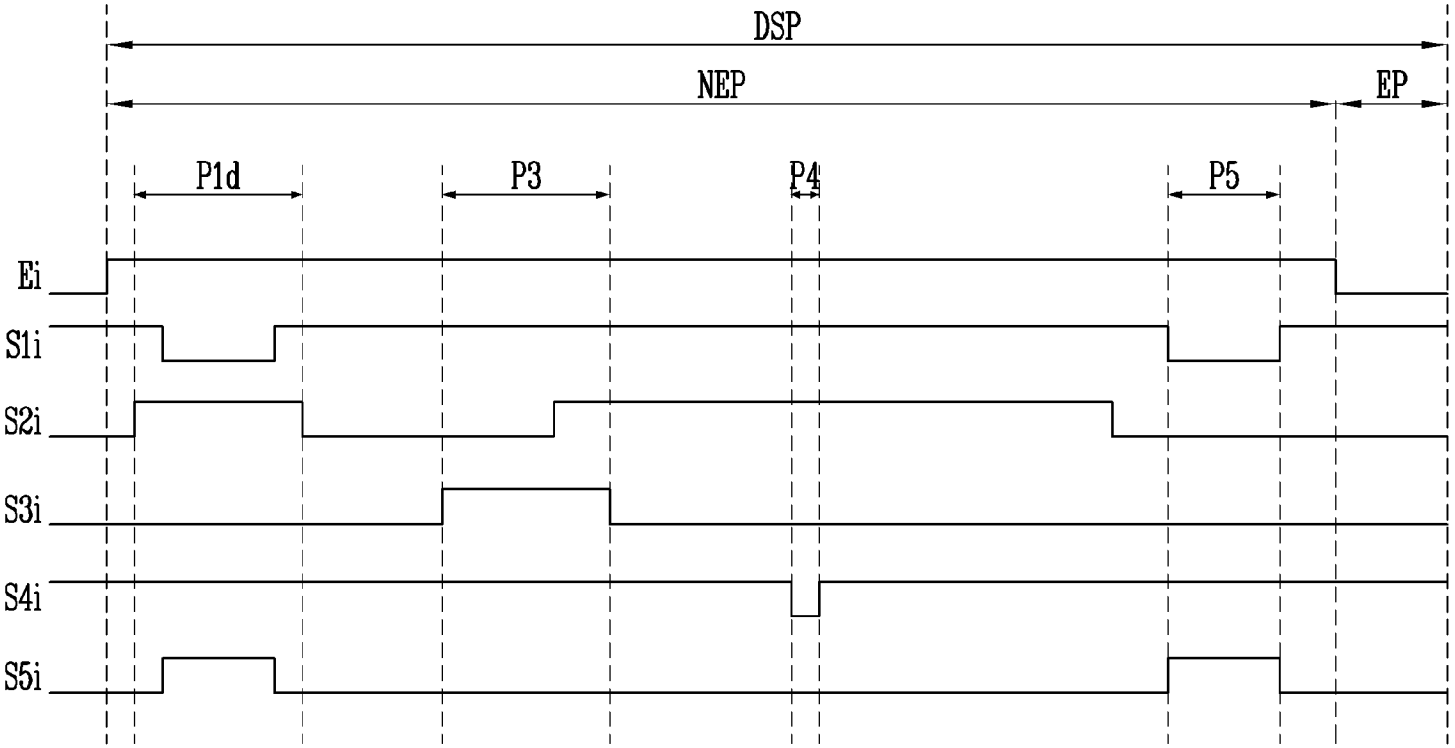

FIGS. 21A and 21B are timing diagrams illustrating examples of the signals supplied to the pixel shown in FIG. 17.

In FIGS. 21A and 21B, for convenience of explanation, descriptions of portions overlapping those described with reference to FIGS. 4, 5, and 19 will be omitted. In addition, portions of FIGS. 21A and 21B are substantially identical or similar to the signals and the operation of the pixel, which are described with reference to FIGS. 4, 5, 17, and 19, except a period in which the first scan signal and the second scan signal overlap each other.

Referring to FIGS. 17, 21A, and 21B, the non-emission period of the display scan period DSP may include a first period P1*c* or P1*d*, a third period P3, a fourth period P4, and a fifth period P5.

An operation of the third period P3, the fourth period P4, and the fifth period P5 is substantially identical to the operation described with reference to FIGS. 3 and 4, and for convenience of explanation, overlapping descriptions will be omitted.

In an embodiment, in the first period P1*c* or P1*d*, the first scan signal, the second scan signal, and the fifth scan signal, which are respectively supplied to the first scan line S1*i*, the second scan line S2*i*, and the fifth scan line S5*i*, may entirely overlap one another. Therefore, in the first period P1*c* or P1*d*, the third transistor M3, the fourth transistor M4, and the eighth transistor M8' may all be simultaneously turned on.

In an embodiment, as shown in FIG. 21A, in the first period P1*c*, pulse widths of the first scan signal, the second scan signal, and the fifth scan signal may all be substantially the same.

In an embodiment, as shown in FIG. 21B, in the first period P1*d*, a pulse width of the second scan signal may be greater than pulse widths of the first and fifth scan signals.

For example, in the first period P1*d*, the third transistor M3 may be turned on earlier than the fourth and eighth transistors M4 and M8', and turned off after the fourth and eighth transistors M4 and M8' are turned off. However, this is merely illustrative. For example, according to embodiments, the third transistor M3 may be turned off earlier than the fourth transistor M4 or be simultaneously turned off with the fourth transistor M4 according to a control with respect to the second scan signal.

For example, the second node N2 and the third node N3 may be electrically connected to each other when the third transistor M3 is turned on. Subsequently, when the fourth transistor M4 is turned on, the voltage of the first power source Vbs may be transferred to the third node N3 through the first node N1. For example, a voltage difference between the first node N1 and the third node N3 may be decreased to a threshold voltage level of the first transistor M1. Therefore, in the first period P1*d*, the magnitude of the gate-source voltage of the first transistor M1 may become very low, and the first transistor M1 may be set to an off-bias state. Accordingly, an unintended luminance increase caused by the supply of the voltage of the first power source Vbs before a data signal is written can be prevented.

In the display device and the method of driving the same in accordance with embodiments of the present disclosure, hysteresis characteristics of the first transistor may be additionally improved by turning on the third transistor in the second period in a state in which the fourth transistor is turned on to apply the on-bias to the first transistor in the first period, so that the step efficiency may be increased.

Also, in the display device and the method of driving the same in accordance with embodiments of the present disclosure, a kickback phenomenon occurring in the gate voltage of the first transistor is eliminated, minimized or reduced by turning on the third transistor (e.g., the second scan signal and the third scan signal overlap each other) in a state in which the seventh transistor is turned on to initialize the gate voltage of the first transistor in the third period, so that light emission with a high luminance of 1000 nits or more may be efficiently implemented.

As is traditional in the field of the present disclosure, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions.

While the present disclosure has been particularly shown and described with reference to embodiments thereof, it will be understood by those of ordinary skill in the art that various changes in form and detail may be made therein without departing from the spirit and scope of the present disclosure as defined by the following claims.

What is claimed is:

1. A display device, comprising:

a pixel comprising a first transistor connected between a first node and a second node, wherein the first transistor generates a driving current, and the pixel is connected to a first scan line, a second scan line, a third scan line, a fourth scan line, an emission control line, and a data line;

an emission driver configured to supply an emission control signal to the emission control line at a first frequency;

a scan driver configured to supply first to fourth scan signals respectively to the first to fourth scan lines within a period in which the emission control signal is supplied; and a data driver configured to supply a data signal to the data line, wherein the first scan signal controls a timing at which a voltage of a first power source is supplied to the first node, wherein the second scan signal controls a timing at which the second node and a gate electrode of the first transistor are connected to each other, wherein the third scan signal controls a timing at which a voltage of a second power source is supplied to the gate electrode of the first transistor, wherein the second scan signal overlaps at least a portion of the first scan signal and at least a portion of the third scan signal, and wherein the scan driver supplies the first scan signal to the first scan line in a first period and a second period, which are consecutive, and supplies the second scan signal to the second scan line in the second period.

2. The display device of claim 1, wherein the pixel further comprises:

a light emitting element;

a second transistor connected between the data line and the first node, the second transistor being turned on in response to the fourth scan signal;

a third transistor connected between the second node and a third node connected to the gate electrode of the first transistor, the third transistor being turned on in response to the second scan signal;

a fourth transistor connected between the first node and a second power line through which the voltage of the first power source is provided, the fourth transistor being turned on in response to the first scan signal;

a fifth transistor connected between a first power line through which a voltage of a driving power source is provided and the first node, the fifth transistor being turned off in response to the emission control signal supplied to the emission control line; and a sixth transistor connected between the second node and a first electrode of the light emitting element, the sixth transistor being turned off in response to the emission control signal.

3. The display device of claim 2, wherein the fourth transistor is turned on in the first period and the second period, and wherein the third transistor is turned on in the second period.

4. The display device of claim 2, wherein, in a third period, the scan driver supplies the third scan signal to the third scan line, and supplies the second scan signal to the second scan line.

5. The display device of claim 4, further comprising:

a seventh transistor connected between the third node and a third power line through which a voltage of the second power source is provided, the seventh transistor being turned on in response to the third scan signal.

6. The display device of claim 5, wherein, in the third period, the seventh transistor is turned on, and the third transistor is turned on in a state in which the seventh transistor is turned on.

7. The display device of claim 5, wherein, in a fourth period, the scan driver supplies the second scan signal and the fourth scan signal respectively to the second scan line and the fourth scan line, and wherein the second transistor and the third transistor are turned on in the fourth period.

8. The display device of claim 7, wherein the scan driver supplies the first scan signal to the first scan line in a fifth period, and wherein the emission driver allows the fifth and sixth transistors to be turned off by supplying the emission control signal during the first to fifth periods.

9. The display device of claim 5, wherein the first, second, fourth, fifth, and sixth transistors include active regions formed in a poly-silicon semiconductor layer, and wherein the poly-silicon semiconductor layer comprises:

a first semiconductor pattern including the active regions of the first, second, fifth, and sixth transistors; and a second semiconductor pattern including the active region of the fourth transistor, the second semiconductor pattern being separated from the first semiconductor pattern.

10. The display device of claim 9, wherein the third and seventh transistors include active regions formed in an oxide semiconductor layer different from the poly-silicon semiconductor layer.

11. The display device of claim 8, wherein the pixel further comprises:

an eighth transistor connected between the first electrode of the light emitting element and a fourth power line through which a voltage of a third power source is provided, the eighth transistor being turned on in response to the first scan signal.

12. The display device of claim 8, wherein the pixel further comprises:

an eighth transistor connected between the first electrode of the light emitting element and a fourth power line through which a voltage of a third power source is provided, the eighth transistor being turned on in response to the emission control signal, and wherein types of the eighth transistor and the fifth transistor are different from each other.

13. The display device of claim 8, wherein the scan driver further supplies a fifth scan signal to a fifth scan line connected to the pixel, wherein the pixel further comprises:

an eighth transistor connected between the first electrode of the light emitting element and a fourth power line through which a voltage of a third power source is provided, the eighth transistor being turned on in response to the fifth scan signal, and wherein the fifth scan signal has a reversed waveform of the first scan signal.

14. The display device of claim 2, wherein the scan driver supplies each of the first scan signal and the second scan signal a plurality of times in a non- emission period.

15. The display device of claim 14, wherein pulse widths of the first to third scan signals are greater than a pulse width of the fourth scan signal.

16. The display device of claim 2, wherein the scan driver supplies the third scan signal and the fourth scan signal at a second frequency corresponding to a frame frequency, and wherein the second frequency is equal to or lower than the first frequency.

17. The display device of claim 16, wherein one frame period includes a plurality of non-emission periods divided by the emission control signal, wherein the scan driver supplies the first scan signal in the non-emission periods, and wherein the scan driver supplies the second scan signal, the third scan signal, and the fourth scan signal in only a first non-emission period among the non-emission periods.

18. The display device of claim 2, wherein the scan driver maintains the supply of the second scan signal to overlap each of the first scan signal, the third scan signal, and the fourth scan signal, and wherein the scan driver supplies the first scan signal, the third scan signal, and the fourth scan signal at different times not to overlap each other.

19. A method of driving a display device, comprising:

applying a voltage of a first power source to a first electrode of a first transistor by supplying a first scan signal to a first scan line in a first period, wherein the display device comprises a pixel connected to the first scan line, a second scan line, a third scan line, a fourth scan line, an emission control line, and a data line, wherein the pixel comprises the first transistor connected between a first node and a second node, and the first transistor generates a driving current;

diode-connecting the first transistor by supplying the first scan signal and a second scan signal respectively to the first scan line and the second scan line in a second period;

applying a voltage of a second power source to a gate electrode and a second electrode of the first transistor by supplying the second scan signal and a third scan signal respectively to the second scan line and the third scan line in a third period;

writing a data signal to the first transistor by supplying the second scan signal and a fourth scan signal respectively to the second scan line and the fourth scan line in a fourth period; and applying, again, the voltage of the first power source to the first electrode of the first transistor by supplying the first scan signal to the first scan line in a fifth period.

20. The method of claim 19, wherein the pixel further comprises:

a light emitting element;

a second transistor connected between the data line and the first node, the second transistor being turned on in response to the fourth scan signal;

a third transistor connected between the second node and a third node connected to the gate electrode of the first transistor, the third transistor being turned on in response to the second scan signal;

a fourth transistor connected between the first node and a second power line through which the voltage of the first power source is provided, the fourth transistor being turned on in response to the first scan signal;

a fifth transistor connected between a first power line through which a voltage of a driving power source is provided and the first node, the fifth transistor being turned off in response to an emission control signal supplied to the emission control line;

a sixth transistor connected between the second node and a first electrode of the light emitting element, the sixth transistor being turned off in response to the emission control signal supplied to the emission control line; and a seventh transistor connected between the third node and a third power line through which a voltage of the second power source is provided, the seventh transistor being turned on in response to the third scan signal.

21. The method of claim 20, wherein the pixel further comprises:

an eighth transistor connected between the first electrode of the light emitting element and a fourth power line through which a voltage of a third power source is supplied, the eighth transistor being turned on in response to the first scan signal, wherein the voltage of the third power source is supplied to the first electrode of the light emitting element through the eighth transistor in the first period and the fifth period.

22. The method of claim 20, wherein the emission control signal is supplied at a first frequency, and the third scan signal and the fourth scan signal are supplied at a second frequency corresponding to a frame frequency, and wherein the second frequency is equal to or lower than the first frequency.

23. The method of claim 22, wherein one frame period includes a plurality of non-emission periods divided by the emission control signal, wherein the first scan signal is supplied in the non-emission periods, and wherein the second scan signal, the third scan signal, and the fourth scan signal are supplied in only a first non-emission period among the non-emission periods.

* * * * *